US005468587A

United States Patent [19]

Bailey et al.

[11] Patent Number: 5,468,587

[45] Date of Patent: Nov. 21, 1995

[54] HYDROGEN BOND ACCEPTING GROUPS ON THERMAL SOLVENTS FOR IMAGE SEPARATION SYSTEMS

[75] Inventors: David S. Bailey; Albert J. Mura, Jr., both of Rochester; Shari L. Eiff, Rush, all of N.Y.

[73] Assignee: Eastman Kodak Company, Rochester, N.Y.

[21] Appl. No.: 73,826

[22] Filed: Jun. 8, 1993

[51] Int. Cl.[6] ..... G03C 8/40; G03C 8/12

[52] U.S. Cl. ..... 430/203; 430/218; 430/351; 430/617; 430/619

[58] Field of Search ..... 430/203, 218, 430/617, 619, 351

[56] References Cited

U.S. PATENT DOCUMENTS

| | | | |
|---|---|---|---|
| T825,478 | 7/1969 | Baxendale et al. . | |
| T867,007 | 10/1969 | Baxendale et al. . | |
| 2,835,579 | 5/1958 | Thirtle et al. . | |
| 3,152,904 | 10/1964 | Sorensen et al. . | |
| 3,347,675 | 10/1967 | Henn et al. . | |
| 3,429,706 | 2/1969 | Shepard et al. . | |
| 3,438,776 | 4/1969 | Yudelson . | |
| 3,442,682 | 5/1969 | Fukawa . | |
| 3,457,075 | 7/1969 | Morgan et al. . | |
| 3,667,959 | 6/1972 | Bojara et al. | 430/617 |
| 4,168,980 | 9/1979 | LaRossa | 430/619 |
| 4,207,393 | 6/1980 | Snyder | 430/546 |
| 4,228,235 | 10/1980 | Okonogi et al. | 430/551 |
| 4,474,874 | 10/1984 | Hirano et al. | 430/551 |
| 4,551,422 | 11/1985 | Kimura et al. | 430/551 |

(List continued on next page.)

FOREIGN PATENT DOCUMENTS

| | | |
|---|---|---|
| 0276319 | 8/1988 | European Pat. Off. . |
| 62-25754 | 2/1987 | Japan . |
| 62-201434 | 9/1987 | Japan . |

*Primary Examiner*—Richard L. Schilling

*Attorney, Agent, or Firm*—Paul A. Leipold

[57] ABSTRACT

An aqueous-developable chromogenic photographic heat-transferable non-aqueous dye-diffusion-transfer photographic element is disclosed, wherein said element comprises radiation sensitive silver halide, a dye-providing compound that forms or releases a heat-transferable image dye upon reaction of said compound with the oxidation product of a primary amine developing agent, a hydrophilic binder, and a thermal solvent for facilitating non-aqueous diffusion transfer according to formula (I)

(I)

wherein

AH is a hydrogen bond donating group with an aqueous $pK_a$ value for proton loss of greater than 6;

$L^1$ and $L^2$ are each independently divalent linking groups consisting of groups of 1 to 12 atoms or are independently absent;

m is 1, 2, or 3;

Q comprises a group of 2 to 15 carbon atoms selected from the group consisting of aromatic rings, alkyl chains, alkyl rings, or ring-chain combinations, optionally substituted with substituents, Z, consisting of alkyl groups or halogens;

B is a hydrogen bond accepting group with an aqueous $pK_a$ value for proton gain of less than 6;

n is 1 or 2;

the groups AH and B cannot hydrogen bond to form a ring of either 5 or 6 atoms;

R is an alkyl, aryl and alkylaryl group of from 1 to 18 carbon atoms;

the calculated log of the octanol/water partition coefficient (clogP) is greater than 3 and less than 10.

36 Claims, 1 Drawing Sheet

U.S. PATENT DOCUMENTS

| | | | |
|---|---|---|---|
| 4,584,267 | 4/1986 | Masukawa et al. | 430/203 |
| 4,590,154 | 5/1986 | Hirai et al. | 430/203 |
| 4,626,494 | 12/1986 | Waki et al. | 430/213 |
| 4,770,989 | 9/1988 | Komamura et al. | 430/203 |
| 4,774,166 | 9/1988 | Sasaki et al. | 430/376 |
| 4,840,870 | 6/1989 | Iwagaki et al. | 430/203 |
| 4,927,731 | 5/1990 | Takahashi | 430/203 |
| 4,952,479 | 8/1990 | Aono et al. | 430/203 |
| 4,983,502 | 1/1991 | Ohbayashi et al. | 430/203 |
| 5,017,454 | 5/1991 | Nakamine et al. | 430/203 |
| 5,032,499 | 7/1991 | Kohno et al. | 430/203 |
| 5,169,742 | 12/1992 | Takahashi et al. | 430/203 |
| 5,270,145 | 12/1993 | Willis et al. | 430/203 |

HYDROGEN BOND ACCEPTING GROUPS ON THERMAL SOLVENTS FOR IMAGE SEPARATION SYSTEMS

FIELD OF THE INVENTION

This invention relates to chromogenic photographic imaging systems that utilize silver halide based radiation sensitive layers and associated formation of image dyes. In particular, this invention relates to such systems where the resulting dye images, when the photographic elements are substantially dry, are transferred to a polymeric receiver layer, thereby separating the developed silver and dye images.

BACKGROUND OF THE INVENTION

Thermal solvents in dry photothermographic systems. Heat processable photosensitive elements can be constructed so that after exposure, they can be processed in a substantially dry state by applying heat. It is known how to develop latent image in a photographic element not containing silver halide wherein organic silver salts are used as a source of silver for image formation and amplification. Such processes are described in U.S. Pat. Nos. 3,429,706 (Shepard et al.) and 3,442,682 (Fukawa et al.). Other dry processing thermographic systems are described in U.S. Pat. Nos. 3,152,904 (Sorenson et al.) and 3,457,075 (Morgan and Shely). A variety of compounds have been proposed as "carriers" or "thermal solvents" or "heat solvents" for such systems, whereby these additives serve as solvents for incorporated developing agents, or otherwise facilitate the resulting development or silver diffusion processes. Acid amides and carbamates have been proposed as such thermal solvents by Henn and Miller (U.S. Pat. No. 3,347,675) and by Yudelson (U.S. Pat. No. 3,438,776). Bojara and de Mauriac (U.S. Pat. No. 3,667,959) disclose the use of nonaqueous polar solvents containing thione, —$SO_2$— and —CO— groups as thermal solvents and carriers in such photographic elements. Similarly, La Rossa (U.S. Pat. No. 4,168,980) discloses the use of imidazoline-2-thiones as processing addenda in heat developable photographic materials. Takahashi (U.S. Pat. No. 4,927,731) discloses a microencapsulated base activated heat developable photographic polymerization element containing silver halide, a reducing agent, a polymerizable compound, contained in a microcapsule and separate from a base or base precursor. In addition the element contains a sulfonamide compound as a development accelerator.

Thermal solvents for use in substantially dry color photothermographic systems have been disclosed by Komamura et at. (U.S. Pat. No. 4,770,981), Komamura (U.S. Pat. No. 4,948,698), Aomo and Nakamaura (U.S. Pat. No. 4,952,479), and Ohbayashi et al. (U.S. Pat. No. 4,983,502). The terms "heat solvent" and "thermal solvent" in these disclosures refer to a non-hydrolyzable organic material which is a liquid at ambient temperature or a solid at an ambient temperature but melts together with other components at a temperature of heat treatment or below but higher than 40° C. Such solvents may also be solids at temperatures above the thermal processing temperature. Their preferred examples include compounds which can act as a solvent for the developing agent and compounds having a high dielectric constant which accelerate physical development of silver salts. Alkyl and aryl amides are disclosed as "heat solvents" by Komamura et al. (U.S. Pat. No. 4,770,981), and a variety of benzamides have been disclosed as "heat solvents" by Ohbayashi et at. (U.S. Pat. No. 4,983,502). Polyglycols, derivatives of polyethylene oxides, beeswax, monostearin, high dielectric constant compounds having an —$SO_2$— or —CO— group such as acetamide, ethylcarbamate, urea, methylsulfonamide, polar substances described in U.S. Pat. No. 3,667,959, lactone of 4-hydroxybutanoic acid, methyl anisate, and related compounds are disclosed as thermal solvents in such systems. The role of thermal solvents in these systems is not clear, but it is believed that such thermal solvents promote the diffusion of reactants at the time of thermal development. Masukawa and Koshizuka disclose (U.S. Pat. No. 4,584,267) the use of similar components (such as methyl anisate) as "heat fusers" in thermally developable light-sensitive materials. Baxendale and Wood in the Defensive Publication corresponding to U.S. application Ser. No. 825,478 filed Mar. 17, 1969 disclose water soluble lower-alkyl hydroxybenzoates as preprocessing stabilizers in silver salt heat-developable photographic elements.

Heat developable thermal dye-diffusion transfer systems. Hirai et al. (U.S. Pat. No. 4,590,154) disclose a heat developable color photographic light-sensitive material comprising silver halide, a hydrophilic binder, dye releasing compounds which release mobile dyes, and a sulfonamide compound. The compounds disclosed by Hirai et al. have, except for a very few examples, a very low octanol/water partition coefficient, or clogP value (see below). This system requires only heat to develop the latent image and to produce mobile dyes. However, the mobile dyes are affixed to an image receiving material, which must be wetted with water prior to being contacted with the heat developed donor element. The subsequent dye diffusion transfer to the receiver element is therefore of the conventional wet diffusion type.

Nakamine et al. (U.S. Pat. No. 5,017,454) disclose a heat developable photographic chromogenic system that also utilizes diffusion transfer of dyes to an image receiving (fixing) element. The dye diffusion transfer in actuality requires that the image receiving or fixing element be wetted with water prior to being affixed to the dye donor element. The resulting dye transfer, therefore, is a wet diffusion transfer of the conventional type, not dry thermal dye transfer. Kohno et al. (U.S. Pat. No. 5,032,499) disclose a heat developable photographic chromogenic system that also utilizes diffusion transfer of dyes to an image receiving element. The compounds taught as promoting thermal transfer are, except for one of 60 examples, ortho substituted hydroxybenzamides of very low clogP value (see below).

Hydroxybenzene Derivatives in Aqueous-developable Non-diffusion-transfer Color Photographic Systems. Okonogi et al. (U.S. Pat. No. 4,228,235) disclose 2,6-dialkyl hydroxybenzoates as dye light-fade stabilizers in a integral photographic, or non-diffusion transfer type, element. Hirano et al. (U.S. Pat. No. 4,474,874) disclose 5-substituted pyrogallols with amide, acyl, sulfone, or sulfate groups as color fog preventative agents (interlayer scavengers) in an integral photographic element or in an aqueous alkali color image transfer element. Takahashi et al. (U.S. Pat. No. 5,169,742) disclose phenols with sulfone, amide and ester substituents as interlayer scavengers in a integral photographic element. Waki et al. (U.S. Pat. No. 4,626,494) describes an aqueous alkali activated image transfer element containing coupler solvents including 2-ethylhexyl hydroxybenzoate. Takahashi et al. (European Patent Application No. 276,319) disclose image generating layers incorporating low levels of hydroxybenzoates, salicylates and o-hydroxybenzophenones as dye light-stabilizers. Thirtle and Weissberger (U.S. Pat. No. 2,835,579) disclose aqueously processable color photographic elements that contains 2,4-di-n-alkyl-, 2-n-alkyl-4-n-alkylacyl- or 2-n-alkylacyl- 4-n-alkylphenols as solvents for dye forming couplers. Sakai et al. (U.S. Pat. No. 4,774,166) disclose seven classes of materials, including as members of one class, arylsulfonylphenols, arylsulfamoylphenols and arylacylphenols as coupling activity enhancing compounds employed in development processes not containing benzyl alcohol. Ishikawa and Sato (Japanese Kokai No. 62-25754) disclose hydroxybenzoates and salicylates as coupling activity enhancing compounds in color photographic elements. Kimura et at. (U.S. Pat. No. 4,551,422) disclose the incorporation of substituted phenols, including alkylphenols, hydroxybenzoates and acylphenols in color photographic elements as hue shifting addenda.

Physical organic characterization of thermal solvents. Materials, especially those that can be treated as substituent variations on an essential functional group, can be described by a variety of extrathermodynamic parameters that relate their activity, according to some performance measure, to their structure. As a central theme of physical-organic chemistry this approach is described in a number of organic chemistry text books, monographs, review articles and review series. Several parameters are employed here that describe the characteristics of the materials that are useful in the practice of this invention. These are the Hammett sigma ($\sigma$) values, which characterize the ability of the ring substituents to effect the electronic nature of the reaction site, the octanol/water partition coefficient as either a substituent parameter or the log of the calculated partition coefficient, clogP, which characterizes the octanol/water partition equilibrium of the entire molecule, the $pK_a$ which measures the tendency of a functional group to lose or gain a proton, as referenced to an aqueous environment, and hydrogen bond donating (HBD) and the hydrogen bond accepting (HBA) character of functional groups.

The Hammett sigma constant, as the seminal member of the family of linear free energy relationships, is described in standard physical organic textbooks such as by T. H. Lowry and K. S. Richardson, "Mechanisms and Theory in Organic Chemistry", 3rd ed., Harper & Row, New York; in monographs such as Shorter, "Correlation Analysis of Organic Reactivity", Research Studies Press, Chichester, Great Britain, 1982 and in specialized series such as *Progress in Physical Organic Chemistry*. The primary and secondary journal literature contains numerous tabulations of Hammett sigma constants such as Hansch et al., *J. Med. Chem.*, 1973, 16, 1207 and Hansch et al., *Chem. Rev.*, 1991, 91, 165. These Hammett sigma values are well established for meta and para substituents, taken for the description of this invention, as relative to the hydrogen bond donating moiety and not involving any enhanced resonance interactions. The apparent sigma values for ortho substituents are often confounded with steric effects leading to a wide variation in the empirically derived substituent ortho sigma values. For the purposes of this invention we have assumed that the ortho sigma values of substituents are equal to its para sigma value. The sigma value for a thermal solvent is the simple algebraic sum of all of the substituents on an aromatic ring exclusive of any hydrogen bond donating substituent.

The application of the octanol/water partition coefficient as logP and the corresponding Hansch pi ($\pi$) substituent parameter has been described by Hansch et al., in *J. Amer. Chem. Soc.*, 1964, 86, 1616, *J. Amer. Chem. Soc.*, 1964, 86, 5175, *Accts. Chem. Res.* 1969, 2, 232, and numerous other subsequent journal articles by these and other authors. Tabulations of the experimentally derived $\pi$ value for numerous substituents are available in the literature, for example, Hansch et al., *J. Med. Chem.*, 1973, 16, 1207, and Hansch and Leo, "Substituent Constants for Correlation Analysis in Chemistry and Biology", Wiley-Interscience, New York, 1985. Partition coefficients can be calculated by fragment additivity relationships. These calculations are relatively simple for additional methylene units in a hydrocarbon chain, but are more difficult in more complex structural variations. An expert computer program, MEDCHEM, Pomona Medchem Software, Pomona College, California (ver. 3.54), permits consistent calculation of partition coefficients as the log value, clogP, from molecular structure inputs and is used in the present invention to calculate these values.

The concept of the hydrogen bond is widely employed in organic chemistry. The hydrogen bond is a bond between a covalently bonded hydrogen and another atom and is usually represented as A-H . . .B where B is any sigma ($\sigma$) or pi ($\pi$) electron donor site (Lewis base), referred to as a hydrogen-bond acceptor (HBA), and A in organic compounds is N, P, O, S and Se and is referred to as a hydrogen bond donor (HBD). These bonds are weaker than normal covalent bonds but are well known to stabilize organic chemical structures. Monographs by Joesten and Schaad, "Hydrogen Bonding", M. Decker New York, 1974 and Pimentel and McClellan, "The Hydrogen Bond", Freeman, San Francisco, 1960 discuss various aspects of this subject. Quantitative assessment of hydrogen bonding characteristics for use in structure-activity relationships have been published. Hansch and Leo in "Substituent Constants for Correlation Analysis in Chemistry and Biology", Wiley-Interscience, New York, 1985 give a binomial scale describing hydrogen bond donating and hydrogen bond accepting character for a wide variety of substituent groups. Drago et al. (*J. Amer. Chem. Soc.*, 197 1, 93, 6014) present a double-scale equation for empirically predicting the strengths of the hydrogen bond formation for a variety of pairs of hydrogen bond donors and receivers. This work emphasizes the concept that the strength of the hydrogen bond is dependent on the characteristics of both the hydrogen bond donor and the hydrogen bond acceptor. M. J. Kamlet and R. W. Taft developed an empirical scale defining the hydrogen bond donating (HBD) parameter $\alpha$ (alpha), and the hydrogen bond accepting (HBA) parameter $\beta$ (beta). The development of these parameters are described in a series of papers beginning in 1976 (*J. Amer. Chem. Soc.*, 1976, 98, 377 and *J. Amer. Chem. Soc.*, 1976, 98, 2886) and are reviewed in *Progress in Physical Organic Chemistry*, 1981, 13, 485 and in *J. Org. Chem.*, 1983, 48, 2877. The methods for determining these molecular characteristics and their use in correlating chemical reactions are described in these and other papers in the series. While the parameters $\alpha$ and $\beta$ refer to molecular characteristics it is clear from inspection of the tables of values provided in the above reviews that functional group contributions useful in the prediction of hydrogen bonding characteristics can be derived from the molecular values.

PROBLEMS TO BE SOLVED BY THE INVENTION

A major problem that remains in wet developed dry thermal transfer systems, wherein the dye images so formed are transferred by diffusion through substantially dry gelatin, is to facilitate the ease with which such dye images may be transferred by diffusion. Another problem that exists is to facilitate such diffusion without inducing the crystallization of said dyes in the gelatin binder. Similar problems of dry dye diffusion transfer exist in color photothermographic systems that rely on dry or heat development processes.

Much of the aforementioned prior an having to do with chromogenic image formation in diffusion transfer processes actually utilize a considerable amount of water in the diffusion process. The diffusion therefore is conventional diffusion transfer, rather than the extremely highly activated diffusion of said dyes through substantially dry gelatin. Diffusion of dyes through wet gelatin, when such dyes have sufficient solubilization, is relatively facile. Much of this same prior art, based on moderately wet diffusion transfer, utilizes imaging chemistry, (dye releasing compounds), that is much more expensive than the simple silver halide based indoaniline dye forming chemistry obtained in conventional wet development of silver halide systems.

These and other problems may be overcome by the practice of our invention.

SUMMARY OF THE INVENTION

An object of the present invention is to overcome the disadvantages of the prior processes and products. A further object of the present invention is to provide improved image dye diffusion transfer efficiency.

A further object of the present invention is to allow separation of the silver, silver halide, and unused chromogenic chemistry from the dye image. Another object of the present invention is to provide a chromogenic imaging system wherein much of the chemistry utilized in creating the image is recoverable and recyclable. Yet another object of the present invention is to provide an imaging system which minimizes toxic effluent and environmental contamination. A significant further object of the present invention is to provide an improved process of image formation comprising eliminating bleaching, fixing and bleach-fixing processing steps.

The invention provides an aqueous-developable chromogenic photographic heat-transferable non-aqueous dye-diffusion-transfer photographic element comprising radiation sensitive silver halide, a dye-providing compound that forms or releases an image dye upon reaction of said compound with the oxidation product of a primary amine developing agent, a hydrophilic binder, and a thermal solvent for facilitating non-aqueous diffusion transfer wherein said thermal solvent has the formula (I)

(I)

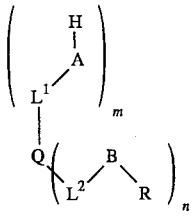

wherein

AH is a hydrogen bond donating group with an aqueous $pK_a$ value for proton loss of greater than 6;

$L^1$ and $L^2$ are each independently divalent linking groups consisting of groups of 1 to 12 atoms or are independently absent;

m is 1, 2, or 3;

Q comprises a group of 2 to 15 carbon atoms selected from the group consisting of aromatic rings, alkyl chains, alkyl rings, or ring-chain combinations, optionally substituted with substituents, Z, consisting of alkyl groups or halogens;

B is a hydrogen bond accepting group with an aqueous $pK_a$ value for proton gain of less than 6;

n is 1 or 2;

the groups AH and B cannot hydrogen bond to form a ring of either 5 or 6 atoms;

R is an alkyl, aryl and alkylaryl group of from 1 to 18 carbon atoms;

the calculated log of the octanol/water partition coefficient (clogP) is greater than 3 and less than 10.

ADVANTAGEOUS EFFECT OF THE INVENTION

We have discovered that selected examples of substituted phenols serve to advantageously improve the diffusion of image dyes through relatively dry photographic binders such as gelatin to a receiver element. Compositions of the present invention yield dramatically improved dye images in receiver layers of the photographic element. This improved dye transfer efficiency enables photographic elements to be constructed using less incorporated chemistry and therefore lower manufacturing costs. The compositions of the present invention eliminate the bleaching and fixing treatments in aqueous developable photographic elements, thus removing a potential source of environmental degradation. The materials in the color photographic element are readily available for recycling.

DETAILED DESCRIPTION OF THE INVENTION

Figure 1:
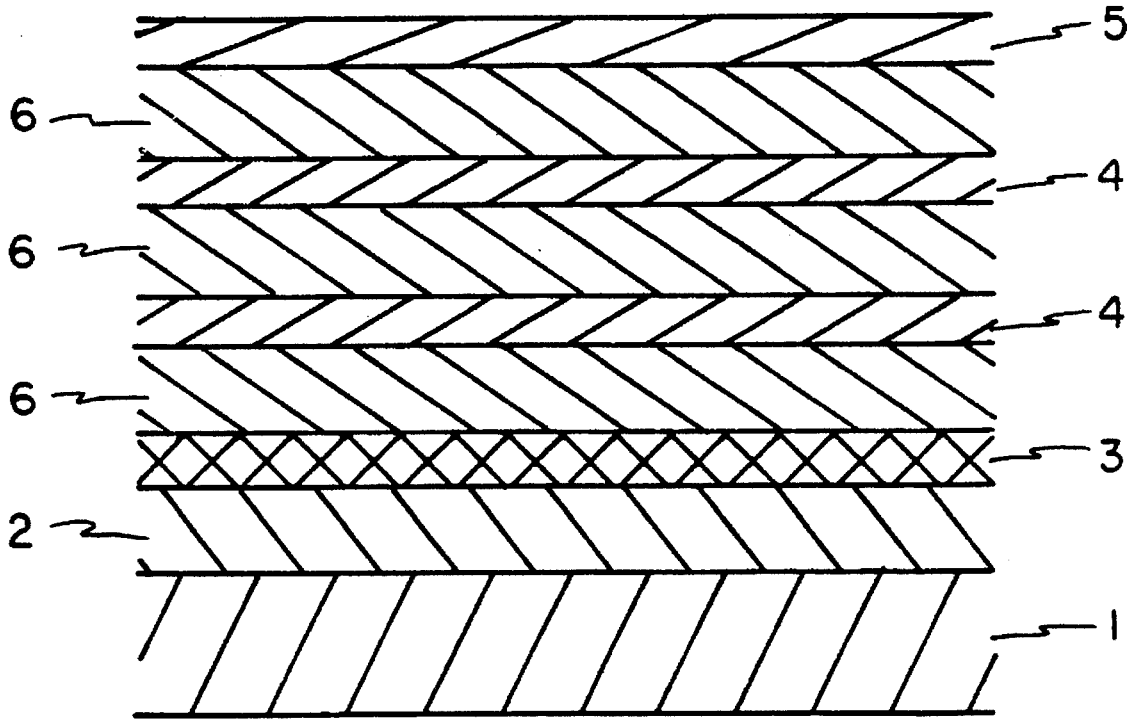
FIG. 1. Photographic element layer-structure for heat image separation system: 1—transparent or reflection base; 2—polymeric receiving layer, 3—stripping layer (optional); 4—interlayers; 5—protective overcoat layer, 6—diffusion transfer dye generation layers. The number of dye generation layers (6) is greater than or equal to one. Interlayers (4) between dye generation layers (6) are optional.

Compositions of the present invention yield dramatically improved dye images in receiver layers of the photographic element. The essential morphology of the an imaging system of the invention is illustrated in FIG. 1. It essentially consists of a conventional multilayer photographic element coated on a polymeric receiver element. The conventional element comprises one or more dye generation layers (6) and optionally one or more interlayers (4) and a protective overcoat (5) layer. This multilayer structure is coated on a receiver layer (2) with an optionally intervening stripping layer (3). The receiver layer (2) is coated on an appropriate transparent or reflection base (1). Images are created by conventional radiation sensitivities in the silver halide emulsion containing layers, and these images are amplified using conventional aqueous color development processes. The development is stopped with an appropriate wash or stop bath, and thereafter the element is dried. After the elements have been dried, they are subjected to heating in order to drive the heat-transferable image dyes to the receiver layer.

Typical aqueous developable elements of the present invention are dried to remove excess water prior to heat to effect heat-transferable dye-diffusion transfer. This drying typically reduces the water content in such elements to less than 50% by weight relative to the hydrophilic binder present in said dement. In preferred embodiments this drying reduces the water content to less than 20% by weight relative to the hydrophilic binder present.

We define the term "heat transferable" used herein as applied to image dyes to mean that said dyes will diffuse through hydrophilic binder when heated to temperatures in excess of 50° C. and when this hydrophilic binder is substantially dry with respect to the absorbed water, where the amount of absorbed water in this binder is less than 50% by weight relative to the binder and furthermore wherein said dyes are substantially insoluble and nondiffusible in aqueous medium of pH 7 to 13.

U.S. Pat. No. 5,164,280, Texter et al., hereby incorporated by reference, discloses a preferred method of separating receiver elements from the imaging layers. The thermal solvents of this invention are particularly effective in aiding the transfer of dyes formed by reaction of couplers with oxidized developer or by other means from imaging layers to a receiver element. The receiving element, containing the transferred dye image, is then separated from the imaging layers. Said separated receiving element constitutes the final print material.

In the present invention, thermal solvents are included in a chromogenic photographic heat-transferable dye-diffusion-transfer element, substantially dry and activated by heat, and comprising contacting dye-receiver and dye-donor layers. It has been found that the thermal solvents of our invention must have both a hydrogen bond donating functional group and a hydrogen bond accepting functional group as separate and distinct functional groups in the same compound. Thermal solvents are provided according to formula (I)

(I)

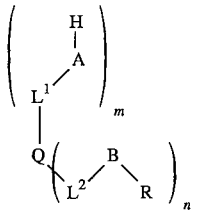

wherein

AH is a hydrogen bond donating group with an aqueous $pK_a$ value proton loss of greater than 6;

$L^1$ and $L^2$ are each independently divalent linking groups consisting of groups of 1 to 12 atoms or are independently absent;

m is 1, 2, or 3;

Q comprises a group of 2 to 15 carbon atoms selected from the group consisting of aromatic rings, alkyl chains, alkyl rings, or ring-chain combinations, optionally substituted with substituents, Z, consisting of alkyl groups or halogens;

B is a hydrogen bond accepting group with an aqueous $pK_a$ value for proton gain of less than 6;

n is 1 or 2;

the groups AH and B cannot hydrogen bond to form a ring of either 5 or 6 atoms;

R is an alkyl, aryl and alkylaryl group of from 1 to 18 carbon atoms;

the calculated log of the octanol/water partition coefficient (clogP) is greater than 3 and less than 10.

These specific examples are meant to illustrate the invention and should not be construed as limiting the scope of the invention.

Examples of typical compounds according to formula (I) are generated from the structural components given in Table I by selection of;

one group from column Q, with selection of appropriate branching groups, $R^b$, from column $R^b$;

either 0, 1, 2, 3, or 4 groups from column Z, where Z is a substituent on an aromatic ring;

one AH—Q linking group $L^1$ from column $L^1$, $L^2$;

one proton donating group from column AH;

one Q—B linking group $L^2$ from column $L^1$, $L^2$ except for the example —OCH2— where the carbon bonding atom from B is not equal to carbon;

one hydrogen bond accepting group from column B, with selection of amine substituent groups, $R^b$, from column $R^b$;

and one group from column R;

such that the clogP of the resulting compound is greater than 3 and less than 10 and such that a hydrogen bonded ring of either 5 or 6 atoms cannot be formed between an atom in B and AH, as for example in salicylates.

In Table I the positional numbering of substituents, Z, are subordinate to that of $L^1$-A—H, which is defined as position 1, and to $L^2$-B—R which is defined in column Q.

Specific examples of preferred compounds according to formula (I) that are included within the scope of the examples given below are generated from the structural components given in Table I by selection of;

one group from column Q being limited to either the 1,4-phenyl, 1,3-phenyl, or 1,2-phenyl ring;

either 0, 1, or 2, groups from column Z being limited to methyl or chlorine;

$L^1$ as absent;

TABLE I

STRUCTURAL TABLE FOR EXAMPLES OF DRY DIFFUSION TRANSFER THERMAL SOLVENTS ACCORDING TO FORMULA (I).

| AH (HBD) | Q | Z | L1, L2 |
|---|---|---|---|
| 1 OH | 1,4-Phenyl | 4-$CH_3$ | • |
| 2 $SO_2NHR^b$ | 1,3-Phenyl | 5-$CH_3$ | —$CH_2$— |
| 3 $NHSO_2R^b$ (1) | 1,2-Phenyl | 6-$CH_3$ | —$CH_2CH_2$— |
| 4 $NHSO_2CF_3$ | —$CH_2CH_2$— | 6-$CH_2$-Q | —$CH_2CH_2CH_2$— |

TABLE I-continued

STRUCTURAL TABLE FOR EXAMPLES OF DRY DIFFUSION TRANSFER THERMAL SOLVENTS ACCORDING TO FORMULA (I).

| | | | | |
|---|---|---|---|---|
| 5 | $NHSO_2CH_2CF_3$ | $—CR^{b2}CR^{b2}—$ | 4-$CH_2CH_3$ | —CH(Me)$CH_2CH_2$— |
| 6 | | —$CH_2(CH_2)_3CH_2$— | 5-$CH_2CH_3$ | —CH=CH— |
| 7 | | —$CH_2CF_2CH_2$— | 4-$CH(CH_3)_2$ | —CH=$CHCH_2$— |
| 8 | | 1,4-cyclohexyl | 6-$CH(CH_3)_2$ | —$CH_2CH(CH_2—)CH_2$— |
| 9 | | 1,3-cyclohexyl | 4-$CH_2CH_2CH_3$ | —$OCH_2$— |
| 10 | | 1,2-cyclohexyl | 5-$CH_2(CH_2)_2CH_3$ | —$OCH_2CH_2$— |
| 11 | | | 6-$CH_2(CH_2)_2CH_3$ | —OCH(Et)$CH_2$— |
| 12 | | | 6-$C(CH_3)_3$ | |
| 13 | | | 4-$C(CH_3)_2CH_2C(CH_3)_3$ | |
| 14 | | | 4-$CH_2(CH_2)_6CH_3$ | |
| 15 | | | 4-Cl | |
| 16 | | | 5-Cl | |
| 17 | | | 6-Cl | |
| 18 | | | | |
| 19 | | | | |
| 20 | | | | |
| 21 | | | | |
| 22 | | | | |
| 23 | | | | |
| 24 | | | | |
| 25 | | | | |
| 26 | | | | |
| 27 | | | | |
| 28 | | | | |
| 29 | | | | |
| 30 | | | | |
| 31 | | | | |
| 32 | (Notes: [(1)]Rb not H) | | | |

| | B (HBA) | $R^b$ | R |
|---|---|---|---|
| 1 | O | H | methyl |
| 2 | S | methyl | ethyl |
| 3 | C(=O)O | ethyl | 1-propyl |
| 4 | OC(=O) | 1-propyl | 2-propyl |
| 5 | C(=O) | 1-butyl | 1-butyl |
| 6 | $NR^b$(C=O) | isobutyl | 2-butyl |
| 7 | C(=O)$NR^b$ | 1-pentyl | isobutyl |
| 8 | OC(=O)O | 1-hexyl | 1-pentyl |
| 9 | OC(=O)$NR^b$ | benzyl | 1-hexyl |
| 10 | $NR^bC$(=O)O | —$CH_2CH_2CH_2$— | 2-hexyl |
| 11 | $NR^bC$(=O)$NR^b$ | | 1-(2-methyl)pentyl |
| 12 | $OS(=O)_2$ | | 1-(2-ethyl)butyl |
| 13 | $S(=O)_2O$ | | 1-heptyl |
| 14 | $S(=O)_2$ | | 1-octyl |
| 15 | $NR^bS(=O)_2$ | | 1-(2-ethyl)hexyl |
| 16 | $S(=O)_2NR^b$ | | 1,8-octyl-(bis) |
| 17 | $OS(=O)_2O$ | | tert-octyl |
| 18 | $OS(=O)_2NR^b$ | | 1-nonyl |
| 19 | $NR^bS(=O)_2O$ | | 1-(3,5,5-tri-Me)hexyl |
| 20 | $NR^bS(=O)_2NR^b$ | | 1-decyl |
| 21 | $NR^bCH_2S(=O)_2$ | | 1-(3,7-dimethyl)octyl |
| 22 | $OP(=O)(—O—)_2$ | | 1,10-decyl-(bis) |
| 23 | | | 1-undecyl |
| 24 | | | 1-dodecyl |
| 25 | | | 1-(2-butyl)octyl |
| 26 | | | 1-tridecyl |
| 27 | | | 1-tetradecyl |
| 28 | | | 1-(2-hexyl)decyl |
| 29 | | | benzyl |
| 30 | | | 1-ethylphenyl |
| 31 | | | 1-propylphenyl |
| 32 | | | phenyl |

the proton donating group from column AH limited to OH;

one Q—B linking group $L^2$ from column $L^1$, $L^2$ except for the example —OCH2— where the carbon bonding atom from B is not equal to carbon;

one hydrogen bond accepting group from column B, limited to esters (C(=O)O, OC(=O)), sulfones ($SO_2$), sulfides (S) and ethers (O);

and one group from column R;

such that the clogP of the resulting compound is greater than 3 and less than 9 and such that a hydrogen bonded ring of either 5 or 6 atoms cannot be formed between an atom in B and AH, as for example, in salicylates.

Specific examples of suitable structures according to formula (I) are shown in Table II.

Binders that can be employed in the aqueous developable photographic element of the present invention are described in *Research Disclosure*, No. 17643, p. 26 (December, 1978)

and *Research Disclosure*, No. 308199, pp. 1003–1004 (December, 1989) (hereafter referred to as RD 308199) and include: synthetic high-molecular weight compounds such as polyvinylbutyral, polyvinyl acetate, ethyl cellulose, cellulose acetate butyrate, polyvinyl alcohol and polyvinylpyrrolidone; synthetic or natural high-molecular weight compounds such as gelatin, gelatin derivatives (e.g., phthalated gelatin), cellulose derivatives, proteins, starches, and gum arabic. These high-molecular weight compounds may be used either singly or in combination. It is particularly preferred to employ gelatin.

The binders are generally used in amounts ranging from 0.05 to 50 g, preferably from 0.2 to 20 g, per square meter of the base support. The binders are preferably used in amounts of 0.1–10 g, more preferably 0.2–5 g, per gram of the dye-providing material.

Couplers may be either four-equivalent, losing two hydrogen atoms from the coupling site during reaction with oxidized color developer, or formally two-equivalent, having a coupling-off group that is lost from the coupler during reaction with the oxidized color developer to form a dye. The coupler fragment that bears the coupling-off group and that forms the dye with the oxidized color developer is referred to as the coupler parent. Coupling-off groups are well known in the art and include, for example, alkylthio, arylthio, aryloxy, N-linked nitrogen heterocycles and chlorine. It is generally preferred in color photographic elements that the molecular weight of the couplers be above 600 (all molecular weights herein are expressed in atomic mass units). The typical molecular weight for these couplers is between 700 and 1100.

TABLE II

| | | | HBA Unit | | | | |
|---|---|---|---|---|---|---|---|
| TS No. | AH | Z | Pos. | Link | HBA | R | cLogP |
| II-1 | 1-OH | • | 4 | • | SO2 | 1-octyl | 4.226 |
| II-2 | 1-OH | • | 4 | • | SO2 | 1-(2-ethyl)hexyl | 4.098 |
| II-3 | 1-OH | • | 4 | • | SO2 | 1-nonyl | 4.755 |
| II-4 | 1-OH | • | 4 | • | SO2 | 1-(3,5,5-trimethyl)hexyl | 4.365 |
| II-5 | 1-OH | • | 4 | • | SO2 | 1-decyl | 5.284 |
| II-6 | 1-OH | • | 4 | • | SO2 | 1-(3,7-dimethyl)octyl | 5.024 |
| II-7 | 1-OH | • | 4 | • | SO2 | 1-dodecyl | 6.342 |
| II-8 | 1-OH | • | 4 | • | SO2 | 1-(2-butyl)octyl | 6.212 |
| II-9 | 1-OH | • | 4 | • | SO2 | 1-tetradecyl | 7.400 |
| II-10 | 1-OH | • | 4 | • | SO2 | 1,8-octyl-bis | ••• |
| | 1-OH | • | 4 | • | SO2 | | 3.526 |
| II-11 | 1-OH | • | 4 | • | SO2 | 1,10-decyl-bis | ••• |
| | 1-OH | • | 4 | • | SO2 | | 4.584 |
| II-12 | 1-OH | • | 4 | • | SO2 | 1,8-octyl-bis | ••• |
| | 1-OH | • | 4 | —CH2CH2CH2— | OC(=O) | | 4.954 |
| II-13 | 1-OH | • | 4 | • | SO2 | 1-(2-hexyl)decyl | 8.328 |
| II-14 | 1-OH | 2-nOct | 4 | • | SO2 | ethyl | 5.284 |
| II-15 | 1-OH | • | 4 | —CH2— | SO2 | 1-(2-ethyl)hexyl | 3.258 |
| II-16 | 1-OH | • | 4 | —CH2— | SO2 | 1-nonyl | 3.915 |
| II-17 | 1-OH | • | 4 | —CH2— | SO2 | 1-dodecyl | 5.502 |
| II-17 | 1-OH | • | 4 | —CH2— | SO2 | 1-(3,7-dimethyl)octyl | 4.184 |
| II-18 | 1-OH | • | 4 | —CH2— | SO2 | 1-(2-hexyl)decyl | 7.488 |
| II-19 | 1-OH | • | 4 | —CH2CH2— | SO2 | 1-decyl | 4.623 |
| II-20 | 1-OH | • | 4 | —CH2CH2— | SO2 | 1-octyl | 3.565 |
| II-21 | 1-OH | • | 4 | —CH2CH2— | SO2 | 1-tetradecyl | 6.739 |
| II-22 | 1-OH | • | 4 | —CH2CH2— | SO2 | 1-(2-butyl)octyl | 5.551 |
| II-23 | 1-OH | • | 4 | —CH2CH2CH2— | SO2 | 1-octyl | 4.094 |
| II-24 | 1-OH | • | 4 | —CH2CH2CH2— | SO2 | 1-decyl | 5.152 |
| II-25 | 1-OH | • | 4 | —CH2(CH2)2CH2— | SO2 | 1-(2-ethyl)hexyl | 4.495 |
| II-26 | 1-OH | • | 4 | —CH2(CH2)3CH2— | SO2 | 1-octyl | 5.152 |
| II-27 | 1-OH | • | 4 | —CH2(CH2)5CH2— | SO2 | 1-butyl | 4.094 |
| II-28 | 1-OH | • | 4 | —CH2(CH2)8CH2— | SO2 | 1-octyl | 7.780 |
| II-29 | 1-OH | • | 4 | —CH2(CH2)10CH2— | SO2 | ethyl | 5.681 |
| II-30 | 1-OH | • | 4 | —OCH2CH2— | SO2 | 1-hexyl | 3.059 |
| II-31 | 1-OH | • | 4 | —OCH2CH2— | SO2 | 1-decyl | 5.175 |
| II-32 | 1-OH | • | 3 | —CH2CH2CH2— | SO2 | 1-nonyl | 4.623 |
| II-33 | 1-OH | • | 3 | —CH2CH2CH2— | SO2 | 1-dodecyl | 6.210 |
| II-34 | 1-OH | • | 4 | • | SO2NH | 1-octyl | 4.222 |
| II-35 | 1-OH | • | 4 | • | SO2NH | 1-(2-ethyl)hexyl | 4.094 |
| II-36 | 1-OH | • | 4 | • | SO2NH | 1-decyl | 5.280 |
| II-37 | 1-OH | • | 4 | • | SO2NH | 1-dodecyl | 6.338 |
| II-38 | 1-OH | • | 4 | • | SO2NH | 1-tetradecyl | 7.396 |
| II-39 | 1-OH | • | 4 | —CH2— | SO2NH | 1-(2-ethyl)hexyl | 3.808 |
| II-40 | 1-OH | • | 4 | —CH2— | SO2NH | 1-decyl | 4.994 |
| II-41 | 1-OH | • | 4 | —CH2— | SO2NH | 1-(2-hexyl)decyl | 8.038 |
| II-42 | 1-OH | • | 4 | —CH2CH2— | SO2NH | 1-octyl | 4.115 |
| II-43 | 1-OH | • | 4 | —CH2CH2— | SO2NH | 1-(2-butyl)octyl | 6.101 |
| II-44 | 1-OH | • | 4 | —CH2CH2CH2— | SO2NH | 1-octyl | 4.644 |
| II-45 | 1-OH | • | 4 | —OCH2CH2— | SO2NH | 1-decyl | 5.175 |
| II-46 | 1-OH | • | 3 | —CH2CH2CH2— | SO2NH | 1-nonyl | 4.623 |
| II-47 | 1-OH | • | 4 | • | SO2NMe | 1-octyl | 3.792 |
| II-48 | 1-OH | • | 4 | • | SO2NHex | 1-hexyl | 5.379 |
| II-49 | 1-OH | • | 4 | —CH2CH2— | NHSO2 | 1-decyl | 5.173 |
| II-50 | 1-OH | • | 4 | • | O | 1-nonyl | 5.806 |

TABLE II-continued

| TS No. | AH | Z | HBA Unit Pos. | HBA Unit Link | HBA Unit HBA | R | cLogP |
|---|---|---|---|---|---|---|---|
| II-51 | 1-OH | • | 4 | • | O | 1-(2-ethyl)hexyl | 5.149 |
| II-52 | 1-OH | • | 4 | —CH2— | O | 1-hexyl | 3.318 |
| II-53 | 1-OH | • | 4 | —CH2— | O | 1-(3,7-dimethyl)octyl | 5.174 |
| II-54 | 1-OH | • | 4 | —CH2CH2— | O | 1-octyl | 4.795 |
| II-55 | 1-OH | • | 4 | —CH2CH2— | O | 1-(2-ethyl)hexyl | 4.667 |
| II-56 | 1-OH | • | 4 | —CH2CH2— | O | 1-(2-butyl)octyl | 6.781 |
| II-57 | 1-OH | • | 4 | —CH2CH2CH2— | O | 1-butyl | 3.208 |
| II-58 | 1-OH | • | 4 | —OCH2CH2— | O | 1-octyl | 5.027 |
| II-59 | 1-OH | • | 4 | —OCH2CH2— | O | 1,8-octyl-bis | ••• |
| | 1-OH | • | 4 | —CH2— | C(=O)O | | 4.957 |
| II-60 | 1-OH | • | 4 | • | S | 1-octyl | 5.737 |
| II-61 | 1-OH | • | 4 | • | S | 1-decyl | 5.806 |
| II-62 | 1-OH | • | 4 | —CH2CH2— | S | 1-propyl | 3.180 |
| II-62 | 1-OH | • | 4 | —CH2CH2— | S | 1-octyl | 5.825 |
| II-63 | 1-OH | • | 4 | —CH2CH2— | S | 1-(2-ethyl)hexyl | 5.695 |
| II-64 | 1-OH | • | 4 | —CH2CH2— | S | 1-(2-butyl)octyl | 7.811 |
| II-65 | 1-OH | • | 3 | —CH2CH2— | S | 1-hexyl | 4.767 |

The coupler compound contained in the aqueous developable color photographic elements of the present invention may be any coupler designed to be developable by color developer solutions, and to form a heat transferable dye upon such development. While color images may be formed with coupler compounds which form dyes of essentially any hue, couplers which form heat transferable cyan, magenta, or yellow dyes upon reaction with oxidized color developing agents are used in preferred embodiments of the invention. Suitable couplers for this invention are disclosed by Willis and Texter in U.S. Ser. No. 804,877, filed Dec. 6, 1991, now U.S. Pat. No. 5,270,145. Preferred couplers for this invention are those that have a coupling-off group. Further, it is preferred that the molecular weight of the parent portion of the coupler be in the range of 90 to 600 and more preferably in the range of 110 to 500 so that the resulting dyes have increased diffusibility. The molecular weight of the entire coupler compound can be adjusted to a selected value by variation to the coupling-off group structure. Couplers that have no readily ionizable functional groups such as sulfonic acids, carboxylic acids, very strongly acidic phenols, or very strongly acidic sulfonamides are preferred in this invention so that their interaction with dry hydrophilic binder, especially gelatin, is minimized.

Suitable heat transferable dye forming compounds of the present invention provide heat transferable dyes that are devoid of functional groups with aqueous $pK_a$ values for proton loss of less than 9. Preferred heat transferable dye forming compounds of the present invention provide heat transferable dyes that are devoid of functional groups with aqueous $pK_a$ values for proton loss of less than 6. In preferred embodiments of the elements of the present invention heat-transferable dye-diffusion transfer is not significantly facilitated at 40° C. and below by wetting with aqueous alkali.

Dye-forming compounds contained in the element of our invention may be linked to a polymer structure so that on reaction with oxidized color developer the dye is chemically released from the polymer. Dye-forming compounds that are linked to polymers through the coupling site are a preferred class of compounds in our invention. Image dye-forming compounds linked to polymers so that the dye remains chemically bound to the polymer are not preferred in this invention because the dye will not readily transfer to the dye receiver layer.

The dye transfer facilitating thermal solvents of this invention may be contained in the same layer as that containing the heat-transferable dye-forming compound or in layers not containing these dye-forming compounds. In elements of two or more layers the thermal solvents of our invention may be contained in any, some or all layers of the element. The dye transfer facilitating thermal solvents of our invention are preferably employed at a loading of between 0 and 300% of the hydrophilic binder in each layer in the photographic element, or more preferably between 0 and 150% of the hydrophilic binder in each layer. Further, the amount of dye transfer facilitating thermal solvent in the element is preferred to be between 10 and 200% of the hydrophilic binder in the element, or more preferably between 15 and 120% of the hydrophilic binder in the element. The thermal solvents of our invention are preferably employed at a level of between 100 to 3000 mg/m$^2$ for photographic elements having only a single color record, between 200 and 4500 mg/m$^2$ for photographic elements having only two color records and between 400 and 6000 mg/m$^2$ for photographic elements comprising three color records.

The photographic elements of our invention may contain high boiling solvents, known in the art as coupler solvents. These high boiling solvents can be employed in dispersions of the heat-transferable dye-forming compounds, interlayer scavengers, thermal solvents, or other compounds contained in the photographic element. The dye-forming compounds in the photographic elements of our invention may be employed without the use of high boiling solvents. These high boiling solvents may increase the reactivity of the heat-transferable dye-forming compound, improve the stability of the dispersion of the dye-forming compound, or may improve the transfer of heat-transferable dye from the dye generation layer to the dye receiver layer. Such high boiling solvents may be selected from any of these compounds known in the art. Coupler solvents may be contained in the dispersions of the dye-forming compounds at amounts between 0 and 400% of the dye-forming compound. High boiling solvents may be contained in dispersions of the dye transfer facilitating thermal solvents of our invention at amounts between 0 and 100% of the thermal solvent. These high boiling solvents may be dispersed with other addenda contained in the photographic element.

The primary amine developing agents useful in the practice of this invention are selected from the p-amino-N,N-dialkylanilines known in the art of color photography.

Examples of these compounds are described, for example, by R. L. Bent et al. (*Photo. Sci. Eng.*, 1963, 8, 125). Primary amine developing agents that have no readily ionizable functional groups such as sulfonic acids or carboxylic acids are preferred in this invention so that the interaction between dry hydrophilic binder, especially gelatin, and the heat-transferable dye formed by the reaction with the dye-forming compound is minimized.

The aqueous developer solution may contain compounds to stabilize the developing agents against oxidation, compounds to minimize precipitation of development products, brightening agents and other compounds to maintain the stability of the developer prior to and during use. The aqueous developer solution can be employed at a wide range of temperatures but is preferred to be in the range of 15° to 55° C. The pH of the aqueous developer solution can be in the range of 8 to 12 with a preferred range of 9 to 11.

A typical multilayer, multicolor photographic element to be used with the thermal solvents of this invention comprises a support having thereon a red-sensitive silver halide emulsion layer having associated therewith a heat-transferable cyan dye image forming coupler compound, a green-sensitive silver halide emulsion layer having associated therewith a heat-transferable magenta dye image forming coupler compound and a blue-sensitive silver halide emulsion layer having associated therewith a heat-transferable yellow dye image forming coupler compound. Each silver halide emulsion layer can be composed of one or more layers and the layers can be arranged in different locations with respect to one another. Typical arrangements are described in RD 308199, the disclosure of which is incorporated by reference.

The light sensitive silver halide emulsions can include coarse, regular or fine grain silver halide crystals of any shape or mixtures thereof and can be comprised of such silver halides as silver chloride, silver bromide, silver bromoiodide, silver chlorobromide, silver chloroiodide, silver chlorobromoiodide and mixtures thereof. The emulsions can be negative working or direct positive emulsions. They can form latent images predominantly on the surface of the silver halide grains or predominantly on the interior of the silver halide grains. They can be chemically or spectrally sensitized. The emulsions typically will be gelatin emulsions although other hydrophilic colloids as disclosed in RD 308199 can be used in accordance with usual practice.

Especially useful in this invention are tabular grain silver halide emulsions. Suitable tabular grain emulsions can be selected from among a variety of conventional teachings, such as those of the following: Research Disclosure, No. 22534, (January, 1983); U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616. More preferred in this invention are tabular silver chloride gains such as disclosed in U.S. Pat. Nos. 5,176,991; 5,176,992; 5,178,998; 5,183,732; 5,185,239 and EP 0534395.

The support can be of any suitable material used with photographic elements. Typically, a flexible support is employed, such as a polymeric film or paper support. Such supports include cellulose nitrate, cellulose acetate, polyvinyl acetal, poly(ethylene terephthalate), polycarbonate, white polyester (polyester with white pigment incorporated therein) and other resinous materials as well as glass, paper or metal. Paper supports can be acetylated or coated with polymer of an alpha-olefin containing 2 to 10 carbon atoms such as polyethylene, polypropylene or ethylene butene copolymers. The support may be any desired thickness, depending upon the desired end use of the element. In general, polymeric supports are usually from about 3 μm to about 200 μm in thickness and paper supports are generally from about 50 μm to about 1000 μm in thickness.

The dye-receiving layer to which the formed heat-transferable dye image is transferred according to the invention may be coated on the photographic element between the emulsion layer and support, or may be in a separate dye-receiving element which is brought into contact with the photographic element during the dye transfer step. If present in a separate receiving element, the dye receiving layer may be coated or laminated to a support such as those described for the photographic element support above, or may be self-supporting. In a preferred embodiment of the invention, the dye-receiving layer is present between the support and any silver halide emulsion layer of an integral photographic element.

The dye receiving layer may comprise any material effective at receiving the heat transferable dye image. Examples of suitable receiver materials include polycarbonates, polyurethanes, polyesters, polyvinyl chlorides, poly(styrene-co-acrylonitrile)s, poly(caprolactone)s and mixtures thereof. The dye receiving layer may be present in any amount which is effective for the intended purpose. In general, good results have been obtained at a concentration of from about 1 to about 10 g/m$^2$ when coated on a support. In a preferred embodiment of the invention, the dye receiving layer comprises a polycarbonate. The term "polycarbonate" as used herein means a polyester of carbonic acid and a glycol or a dihydric phenol. Examples of such glycols or dihydric phenols are p-xylylene glycol, 2,2-bis(4-oxyphenyl)propane, bis(4-oxyphenyl)methane, 1,1-bis(4-oxyphenyl)ethane, 1,1-bis(oxyphenyl)butane, 1,1-bisphenol-A polycarbonate having a number average molecular weight of at least about 25,000. Examples of preferred polycarbonates include General Electric LEXAN® Polycarbonate Resin and Bayer AG MACROLON® 5700. Further, a thermal dye transfer overcoat polymer as described in U.S. Pat. No. 4,775,657 may also be used.

Heating times of from about 10 seconds to 30 minutes at temperatures of from about 50° to 200° C. (more preferably 75° to 160° C., and most preferably 80° to 120° C.) are preferably used to activate the thermal transfer process. This aspect makes it possible to use receiver polymers that have a relatively high glass transition temperature (Tg) (e.g., greater than 100° C.) and still effect good transfer, while minimizing back transfer of dye (diffusion of dye out of the receiver onto or into a contact material).

While essentially any heat source which provides sufficient heat to effect transfer of the developed heat-transferable dye image from the emulsion layer to the dye receiving layer may be used, in a preferred embodiment dye transfer is effected by running the developed photographic element with the dye receiving layer (as an integral layer in the photographic element or as part of a separate dye receiving element) through a heated roller nip. Thermal activation transport speeds of 0.1 to 50 cm/sec are preferred to effect transfer at nip pressures of from about 500 Pa to 1,000 kPa and nip temperatures of from about 75° to 190° C.

In preferred embodiments of the aqueous developable elements of the present invention containing an integral receiver the amount of heat-transferable dye density transferred through drying is less than 15% of the total dye density transferable through drying and heating.

Another preferred method of imaging combines thermal or heat development of radiation sensitive silver halide, usually in the presence of an organic silver salt and an incorporated reducing agent, with thermally activated diffusion transfer of image dyes to a polymeric receiver. Such systems are described in U.S. Pat. Nos. 4,584,267, 4,590,154, 4,595,652, 4,770,981, 4,871,647, 4,948,698, 4,952,479, and 4,983,502, the disclosures of which are incorporated herein by reference. Such materials generally comprise a plurality of radiation sensitive layers. A typical radiation sensitive layer comprises radiation sensitive silver halide, an organic silver salt, a reducing agent, a dye forming or donating compound, a binder, and in preferred embodiments, one or more thermal solvents to facilitate the heat development of the silver halide and organic silver salt and the transfer of the resulting image dye to a suitable receiving element. In preferred multilayer materials, radiation sensitive layers sensitive to blue, green, and red light are included that produce yellow, magenta, and cyan heat-transferable image dyes for diffusion transfer, respectively. Thermal solvents and heat solvents of the type disclosed in the aforesaid U.S. Patent documents and disclosed herein by reference are included to facilitate heat development and thermal dye transfer. The preferred thermal solvents of the present invention serve to facilitate the thermal dye transfer of dyes through the binder to the receiver element.

The coupler compound to be used in this process of the invention may be any dye forming, dye providing, or dye donating material that will produce a heat transferable dye upon heat development. Preferred dye forming compounds are those that provide heat transferable cyan, magenta, or yellow dyes upon heat development.

The dye-providing materials of the present invention may be used either on their own or as admixtures. If desired, they may be used in combination with dye-providing materials of the type described in such patents as U.S. Pat. Nos. 4,631,251, 4,656,124, and 4,650,748.

The amount of the dye-providing materials used is not limited and may be determined according to their type, the manner in which they are used (i.e., either singly or in combination) or the number of photographic constituent layers of which the heat-processible photographic material of the present invention is composed (i.e., a single layer or two or more layers in superposition). As a guide, the dye-providing materials may be used in an amount of 0.005–50 g, preferably 0.1–10 g, per square meter. The dye-providing materials for use in the present invention may be incorporated in photographic constituent layers of the heat-processible photographic material by any suitable method.

The light-sensitive silver halide to be used in the present invention may include, for example, silver chloride, silver bromide, silver iodide, silver chlorobromide, silver chloroiodide and silver iodobromide. Such light-sensitive silver halides can be prepared by any of the methods commonly employed in the photographic art.

If desired, a silver halide emulsion having silver halide grains with a duplex structure (i.e., the halide composition of the grain surface differing from that of the interior) may be used and an example of such duplex grains is core/shell type silver halide grains. The shell of these grains may change in halide composition stepwise or gradually. The silver halide grains used may have a well-defined crystal habit as in cubes, spheres, octahedra, dodecahedra or tetradecahedra. Alternatively, they may not have any well-defined crystal shape. The silver halide grains in these light-sensitive emulsions may be coarse or fine; preferred grain sizes are on the order of 0.005 μm to 1.5 μm in diameter, with the range of from about 0.01 to about 0.5 μm being more preferred.

According to another method for preparing light-sensitive silver halides, a light-sensitive silver salt forming component may be used in the presence of organic silver salts (to be described below) so as to form light-sensitive silver halides in part of the organic silver salts.

These light-sensitive silver halides and light-sensitive silver salt forming component may be used in combination in a variety of methods, and the amount used in one photographic layer preferably ranges from 0.001 to 50 g, preferably 0.1–10 g, per square meter of base support.

The light-sensitive silver halide emulsions illustrated above may be chemically sensitized by any of the methods commonly employed in the photographic art. The light-sensitive silver halide emulsions to be used in the present invention may be spectrally sensitized with known spectral sensitizers in order to provide sensitivity to the blue, green, red, or near-infrared region.

Typical examples of the spectral sensitizers that can be used in the present invention include cyanine dyes, merocyanine dyes, complex (tri- or tetra-nuclear) cyanine dyes, holopolar cyanine dyes, styryl dyes, hemicyanine dyes and oxonol dyes. These sensitizers are incorporated in amounts ranging from $1\times10^{-4}$ to 1 mole, preferably from $1\times10^{-4}$ to $1\times10^{-1}$ mole, per mole of the light-sensitive silver halide or silver halide forming component. The sensitizers may be added at any stage of the preparation of silver halide emulsions; they may be added during the formation of silver halide grains, during the removal of soluble salts, before the start of chemical sensitization, during chemical sensitization or after completion of the chemical sensitization.

A variety of organic silver salts may optionally be employed in the heat-processible photographic material of the present invention in order to increase its sensitivity or improve its developability.

Illustrating organic silver salts that may be employed in the heat-processible photographic material of the present invention include: silver salts of long-chain aliphatic carboxylic acids and silver salts of carboxylic acids having a hetero ring, such as silver behenate and silver α-(1-phenyltetrazolethio) acetate (see U.S. Pat. Nos. 3,330,633, 3,794,496 and 4,105,451); and silver salts of an imino group as described in U.S. Pat. No. 4,123,274.

Among the organic silver salts listed above, silver salts of an imino group are preferred. Particularly preferred are silver salts of benzotriazole derivatives such as 5-methylbenzotriazole or derivatives thereof, sulfobenzotriazole or derivatives thereof and N-alkylsulfamoylbenzotriazole or derivatives thereof.

These organic silver salts may be used either singly or as admixtures in the present invention. Silver salts prepared in suitable binders may be immediately used without being isolated. Alternatively, isolated silver salts may be dispersed in binders by suitable means before they are used. The organic silver salts are preferably used in amounts ranging from 0.01 to 500 moles, more preferably from 0.1 to 100 moles, most preferably from 0.3 to 30 moles, per mole of the light-sensitive silver halide.

The reducing agent for use in the heat-processible photographic material of the present invention (the term "reducing agent" as used herein shall include precursors of the reducing agent) may be selected from among those which are commonly employed in the field of heat-processible photographic materials.

Reducing agents that can be used in the present invention include: p-phenylenediamine developing agents or their precursors, p-aminophenolic developing agents, phosphoroamidophenolic developing agents, sulfonamidoaniline-based developing agents, hydrazone-based color developing agents, and precursors of these developing agents, such as those described in U.S. Pat. Nos. 3,531,286, 3,761,270, and 3,764,328. Also useful are phenols, sulfonamidophenols, polyhydroxybenzenes, naphthols, hydroxybinaphthyls, methylenebisnaphthols, methylenebisphenols, ascorbic acids, 3-pyrazolidones, pyrazolones, etc. The reducing agents may be used either on their own or as admixtures. The amount in which the reducing agents are used in the heat-processible photographic material of the present invention depend upon many factors such as the type of light-sensitive silver halide used, the type of organic acid silver salt, and the type of other additives used. Usually, the reducing agents are used in amounts ranging from 0.01 to 1,500 moles per mole of light-sensitive silver halide, with the range of 0.1–200 moles being preferred.

Illustrative binders that can be employed in the heat-processible photographic material of the present invention include: synthetic high-molecular weight compounds such as polyvinylbutyral, polyvinyl acetate, ethyl cellulose, polymethyl methacrylate, cellulose acetate butyrate, polyvinyl alcohol and polyvinylpyrrolidone; synthetic or natural high-molecular weight compounds such as gelatin, gelatin derivatives (e.g., phthalated gelatin), cellulose derivatives, proteins, starches, and gum arabic. These high-molecular weight compounds may be used either singly or in combination. It is particularly preferred to employ gelatin or its derivatives in combination with synthetic hydrophilic polymers such as polyvinylpyrrolidone and polyvinyl alcohol. A more preferred binder is a mixture of gelatin and polyvinylpyrrolidone.

The binders are generally used in amounts ranging from 0.05 to 50 g, preferably from 0.2 to 20 g, per square meter of the base support. The binders are preferably used in amounts of 0.1–10 g, more preferably 0.2–5 g, per gram of the dye-providing material.

The heat-processible photographic material of the present invention is produced by forming photographic constituent layers on a base support. A variety of base supports can be used and they include: synthetic plastic films such as a polyethylene film, a cellulose acetate film, a polyethylene terephthalate film, and a polyvinyl chloride film; paper bases such as photographic raw paper, printing paper, baryta paper and resin-coated paper, and base prepared by coating these materials with electron-beam curable resin compositions, followed by curing of the same.

The heat-processible photographic material of the present invention is suitable for processing by transfer photography using an image-receiving member. In the practice of the present invention, a variety of thermal solvents are preferably incorporated in the heat-processible photographic material and/or the image-receiving member.

Particularly useful thermal solvents are urea derivatives (e.g., dimethylurea, diethylurea and phenylurea), amide derivatives (e.g., acetamide, benzamide and p-toluamide), sulfonamide derivatives (e.g., benzenesulfonamide and α-toluenesulfonamide), and polyhydric alcohols (e.g., 1,6-hexanediol, 1,2-cyclohexanediol and pentaerythritol, and polyethylene glycol. Water-insoluble solid thermal solvents may be used with particular advantage.

Thermal solvents may be incorporated in various layers such as light-sensitive silver halide emulsion layers, intermediate layers, protective layers, and image-receiving layers in an image-receiving member so that the results desired in respective cases can be obtained.

Thermal solvents are usually incorporated in amounts ranging from 10 to 500 wt %, preferably from 30 to 200 wt %, of the binder in the element.

The organic silver salts and thermal solvents may be dispersed in the same liquid dispersion system. The binder, dispersion medium and dispersing apparatus used in this case may be the same as those employed in preparing the respective liquid dispersions.

Besides the components described above, the heat-processible photographic material of the present invention may incorporate various other additives such as development accelerators, antifoggants, base precursors, etc.

Illustrative base precursors include compounds that undergo decarboxylation upon heating to release a basic substance (e.g., guanidium trichloroacetate) and compounds that are decomposed by reactions such as intramolecular nucleophilic substitution reaction to release amines. Other additives that are used as required in heat-processible photographic materials may also be incorporated in the heat-processible photographic material of the present invention. Illustrative additives include antihalation dyes, brighteners, hardeners, antistats, plasticizers, extenders, matting agents, surface-active agents and antifading agents. These additives may be incorporated not only into light-sensitive layers but also into non-light-sensitive layers such as intermediate layers, protective layers and backing layers.

The heat-processible photographic material of the present invention contains (a) a light-sensitive silver halide, (b) a reducing agent, (c) a binder and (d) the dye-providing material of the present invention. Preferably, it further contains (e) an organic silver salt as required. In a basic mode, these components may be incorporated in one heat-processible light-sensitive layer but it should be noted that they are not necessarily incorporated in a single photographic constituent layer but may be incorporated in two or more constituent layers in such a way that they are held mutually reactive. In one instance, a heat-processible light-sensitive layer is divided into two sub-layers and components (a), (b), (c) and (e) are incorporated in one sub-layer with the dye-providing material (d) being incorporated in the other sub-layer which is adjacent to the rust sub-layer. The heat-processible light-sensitive layer may be divided into two or more layers including a highly sensitive layer and a less sensitive layer, or a high-density layer and a low-density layer.

The heat-processible photographic material of the present invention has one or more heat-processible light-sensitive layers on a base support. If it is to be used as a full-color light-sensitive material, the heat-processible photographic material of the invention generally has three heat-processible light-sensitive layers having different color sensitivities, each light-sensitive layer forming or releasing a dye of different color as a result of thermal development. A blue-sensitive layer is usually combined with a yellow dye, a green-sensitive layer with a magenta dye, and a red-sensitive layer with a cyan dye, but different combination may be used.

The choice of layer arrangements depends on the objective of a specific use. For instance, a base support is coated with a red-sensitive, a green-sensitive and a blue-sensitive layer, or in the reverse order (i.e., a blue-sensitive, a green-sensitive and a red-sensitive layer), or the support may be coated with a green-sensitive, a red-sensitive and a blue-sensitive layer.

Besides the heat-processible light-sensitive layers described above, the heat-processible photographic material of the present invention may incorporate non-light-sensitive layers such as a subbing layer, an intermediate layer, a protective layer, a filter layer, a backing layer and a release layer. The heat-processible light-sensitive layers and these non-light-sensitive layers may be applied to a base support by coating techniques that are similar to those commonly employed to coat and prepare ordinary silver halide photographic materials.

The heat-processible photographic material of the present invention is developed after imagewise exposure and this can usually be done by merely heating the material at a temperature in the range of 80°–200° C., preferably 100°–170° C., for a period of from 1–180 seconds, preferably 1.5–120 seconds. A diffusible dye may be transferred onto an image-receiving layer simultaneously with thermal development by bringing the image-receiving layer in the image-receiving member into intimate contact with the light-sensitive surface of the photographic material. Alternatively, the photographic material brought into intimate contact with the image-receiving member after thermal development may be subsequently heated. The photographic material may be preliminarily heated in the temperature range of 70°–180° C. prior to exposure. In order to enhance the adhesion between the photographic material and the image-receiving member, they may be separately heated at a temperature of 80°–250° C. just prior to thermal development and transfer.

The heat-processible photographic material of the present invention permits the use of a variety of known heating techniques. All methods of heating that can be used with ordinary heat-processible photographic materials may be applied to the heat-processible photographic material of the present invention. In one instance, the photographic material may be brought into contact with a heated block or plate, or with heated rollers or a hot drum. Alternatively, the material may be passed through a hot atmosphere. High-frequency heating is also applicable. The heating pattern is in no way limited; preheating may be followed by another cycle of heating; heating may be performed for a short period at high temperatures or for a long period at low temperatures; the temperature may be elevated and lowered continuously; repeated cycles of heating may be employed; the heating may be discontinuous rather than continuous. A simple heating pattern is preferred. If desired, exposure and heating may proceed simultaneously.

Any image-receiving member may effectively be used in the present invention if the image-receiving layer employed has a capability for accepting the dye released or formed in the heat-processible light-sensitive layer as a result of thermal development. A preferred example is a polymer containing a tertiary amine or quaternary ammonium salt, as described in U.S. Pat. No. 3,709,690. Typical image-receiving layers suitable for use in diffusion transfer can be prepared by coating a base support, with a mixture in which a polymer containing an ammonium salt or tertiary amine is combined with gelatin or polyvinyl alcohol. Another useful dye-receiving layer may be formed of a heat-resistant organic high-molecular weight substance having a glass transition point of 40°–250° C. These polymers may be carried as image-receiving layers on a base support; alternatively, they may be used as bases on their own.

Synthetic polymers having glass transition points of 40° C. and above as described in "Polymer Handbook," 2nd ed., edited by J. Brandrup and E. H. Immergut, John Wiley & Sons are also useful. Useful molecular weights of these high-molecular weight substances are generally in the range of 2,000–200,000. These high-molecular weight substances may be used either independently or as blends. Two or more monomers may be employed to make copolymers. Particularly preferred image-receiving layers comprise polyvinyl chloride and polycarbonate, and a plasticizer.

The polymers described above may be used as base supports that also serve as image-receiving layers to form image-receiving members. In this case, the base support may be formed of a single layer or two or more layers.

Base supports for image-receiving members may be transparent or non-transparent. Illustrative supports include: films of polymers such as polyethylene terephthalate, polycarbonate, polystyrene, polyvinyl chloride, polyethylene and polypropylene; base supports having pigments such as titanium oxide, barium sulfate, calcium carbonate and talc incorporated in these plastic films; baryta paper; resin-coated (RC) paper having paper laminated with pigment-loaded thermoplastic resins; fabrics; glass; metals such as aluminum; base supports prepared by coating these materials with pigment-loaded electron beam curable resin compositions, followed by curing of the latter, and base supports having pigment-loaded coating layers on these materials.

Particularly useful are the base support prepared by coating paper with a pigment-loaded electron-beam curable resin composition, followed by curing of the resin, and the base support prepared by applying a pigment coating layer to paper, which is then coated with an electron-beam curable resin composition, followed by curing of the resin. These base supports can immediately be used as image-receiving members since the resin layer itself serves as an image-receiving layer.

The heat-processible photographic material of the present invention may be of the integral type in which the light-sensitive layer and the image-receiving layer are formed on the same base support.

The heat-processible photographic material of the present invention is preferably provided with a protective layer. The protective layer may contain a variety of additives that are commonly employed in the photographic industry. Suitable additives include matting agents, colloidal silica, slip agents, organofluoro compounds (in particular, fluorine-based surface active agents), antistats, uv absorbers, high-boiling organic solvents, anti-oxidants, hydroquinone derivatives, polymer lattices, surface-active agents (including high-molecular weight surface-active agents), hardeners (including high-molecular weight hardeners), particulate organic silver salts, non-light-sensitive silver halide grains, development accelerators, etc.

A preferred embodiment of the present invention comprises a multilayer heat-developable color-photographic material comprising a dye-diffusion-transfer element, activated by heat, said transfer element comprising contacting dye-receiver and dye-donor layers, where said receiver layers comprise a support, a polymeric layer comprising materials which have a high binding affinity for the yellow, magenta, and cyan dyes, and where said donor layers comprise a yellow dye producing layer, said layer comprising light-sensitive silver halide grains, an organic silver salt, a reducing agent, a yellow dye providing compound, and a hydrophilic binder, a magenta dye producing layer, said layer comprising light-sensitive silver halide grains, an organic silver salt, a reducing agent, a magenta dye providing compound, and a hydrophilic binder, a cyan dye producing layer, said layer comprising light-sensitive silver halide grains, an organic silver salt, a reducing agent, a cyan dye providing compound, and a hydrophilic binder, wherein said binder of said layers amount to from 3 to 10 g/m$^2$ of said coated material. These dyes are heat-transferable dyes. The dye-receiver and dye-donor layers may be coated together in a single, integral element. Alternatively, the dye-receiver and dye-donor layers may be coated in separate elements, said elements being laminated together prior to the thermal dye-diffusion transfer process. The preferred amount of thermal solvent according to formula I incorporated in a given layer is 0 to 300% by weight of the total amount of binder present in said layer. The amount of such thermal solvent incorporated in a given layer is 20 to 150% by weight of the total amount of binder present in said element.

The advantages of the present invention will become more apparent by reading the following examples. The scope of the present invention is by no means limited by these examples, however.

EXAMPLES

The following examples are meant to be illustrative of the invention and not limiting in the materials described nor exhaustive in describing all the forms of practice.

The thermal solvents according to formula (I) that are employed in the following examples are shown below:

TS-1

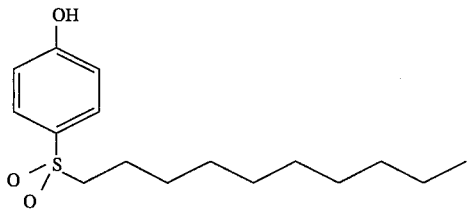

TS-2

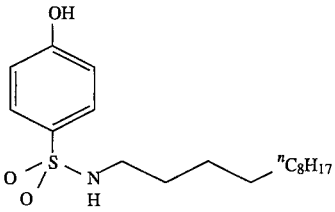

TS-3

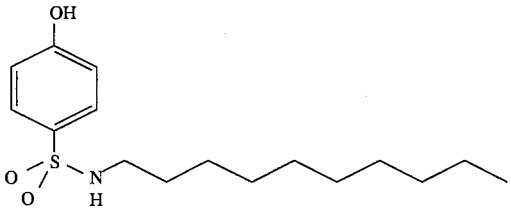

TS-4

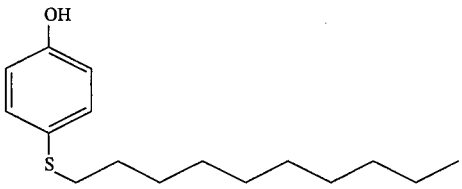

TS-5

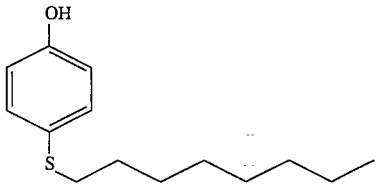

-continued

TS-6

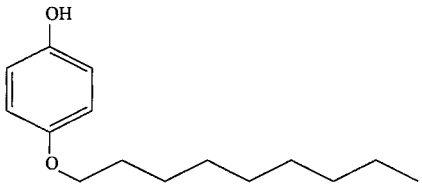

Synthesis of Selected Thermal Solvents.

4-methoxy-n-Decylsulfamoylbenzene: Commercially available 4-methoxybenzenesulfonylchloride (Aldrich; 25 g, 0.12 moles) is added portionwise to a solution of decylamine (Kodak; 19 g, 0.12 moles) in pyridine (75 mL). The heterogeneous reaction mixture is stirred overnight at room temperature and poured into dilute HCl/ice water (1.5 L). After stirring 30 minutes, the light orange solid is isolated by filtration, washed with water and air dried. Recrystallization from ethanol (Norite) affords 26.3 g (66% yield) of the desired product as golden platelets, mp 53°–54.5° C. NMR ($CDCl_3$) d 0.8–0.95 (t, 3H's); 1.1–1.6 (m, 16H's); 2.8–3.0 (t, 2H's); 3.9 (s, 3H's); 6.95–7.0 (d, 2H's); 7.75–7.85 (d, 2H's).

TS-3; 4-hydroxy-n-Decylsulfamoylbenzene: The above methyl ether (16.37 g, 0.05 moles) and sodium cyanide (Kodak; 12.3 g, 0.25 moles) is dissolved in dimethylsulfoxide (100 mL) under $N_2$ and heated at reflux for 6 hours. The cooled reaction mixture is poured into ice water (1200 mL) and carefully acidified with concentrated, HCl. The tacky unstirrable material solidified on standing overnight. After breaking the solid it is allowed to stir for a few additional hours and the solid, collected by filtration, is washed with water and air dried. The crude material is chromatographed on silica with 1% acetone/$CH_2Cl_2$ and the concentrated, enriched fractions are rechromatographed on silica with 3% acetone/$CH_2Cl_2$. The resultant solid is stirred in hexanes overnight and filtered to afford 10 g (64% yield) of the desired phenol as a cream colored solid, mp 78°–80° C. FDMS, m/e=313M. NMR ($CDCl_3$); δ0.87 (t, 3H's); 1.1–1.35 (m, 16H's); 2.91 (q, 2H's); 4.48 (t, 1H); 6.43 (s, 1H); 6.92 (d, 2H's); 7.71 (d, 2H's). Calculated for $C_{16}H_{27}NO_3S$: C, 61.31; H, 8.68; N, 4.47; S, 10.23. Found: C, 61.07; H, 8.57; N, 4.38; S, 10.29.

TS-4; 4-(n-Decylthio)hydroxybenzene: A mixture of commercially available p-hydroxythiophenol (TCI; 8 g, 0.0634 moles) cesium carbonate (Aldrich; 10.3 g, 0.0317 moles) and decylbromide (Kodak; 14.7 g, 0.0665 moles) in DMF (100 mL) is sonicated (ACE Glass Ultrasonic Processor-600 W; ½" horn and extender; control=10; 50% duty cycle) with ice bath cooling for 1.75 hours. The mixture is poured into ice water (800 mL), with stirring. The resulting white solid, isolated by filtration, is washed with water and air dried. This affords 15.8 g (93.5% yield) of the desired product, pure by TLC, mp 75°–77° C. NMR($CDCl_3$); δ0.85 (t, 3H's); 1.2–1.7 (m, 16H's); 2.8 (t, 2H's); 6.75 (d, 2H's); 7.3 (d, 2H's).

TS-1; 4-n-Decylsulfonylphenol: To a solution of m-chloroperbenzoic acid (Kodak; 80%; 23.8 g, 0.11 moles) is added portionwise over 2 hours the above sulfide (14 g, 0.0525 moles) in $CH_2Cl_2$ (250 mL). After stirring overnight, a small additional amount of m-chloroperbenzoic acid is added and the mixture stirred for 24 hours. The mixture is filtered to remove m-chlorobenzoic acid and the filtrate freed of solvent under vacuum. The resulting solid is chromatographed on silica (starting at 97:3, increasing polarity to 95:5, $CH_2Cl_2$:acetone). The concentrated, enriched fractions still contain m-chlorobenzoic acid. The solid is dissolved in $CH_2Cl_2$ and washed with saturated bicarbonate solution and brine. The dried ($Na_2SO_4$) organic layer is passed (with the help of vacuum) through a plug made up of a top layer of silica gel, a layer of $Na_2SO_4$, and a layer of celite. The plug is washed with $CH_2Cl_2$ until all product is removed. Solvent removal affords a clear oil which solidified on standing to give 12 g (76% yield) of a waxy white solid. FDMS, m/e=298M. NMR ($CDCl_3$), δ0.85 (t, 3H's); 1.1–1.8 (m, 16H's); 3.05–3.15 (m, 2H's); 6.6 (s, 1H); 6.95 (d, 2H's); 7.75 (d, 2H's).

Photographic couplers employed in the examples are given below:

M-1

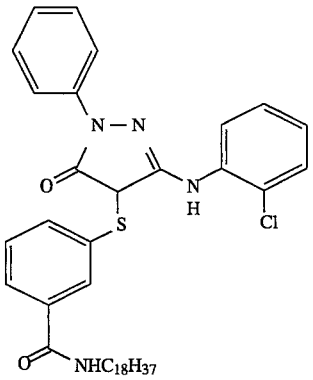

Y-1

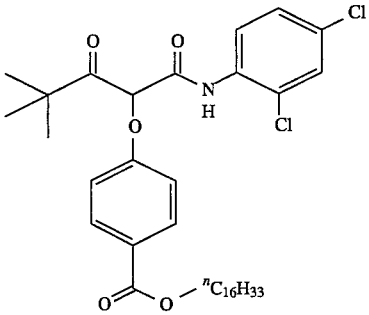

Figure 2:
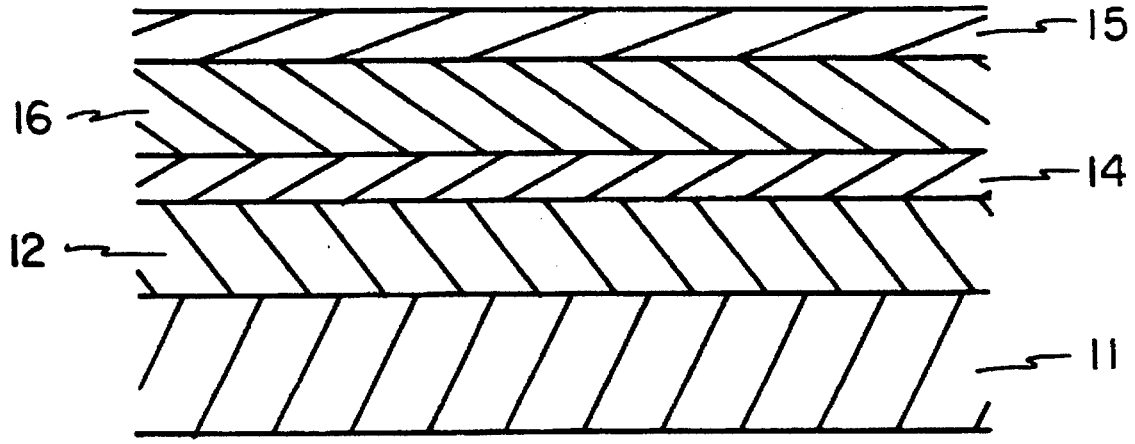
FIG. 2. Test coating format layer structure: 11—transparent or reflection base; 12—polymeric receiving layer, 14—interlayer containing gelatin and optionally thermal solvent; 15—protective overcoat layer, 16—diffusion transfer dye generation layer.

The following 17 examples are prepared to examine the ability of materials to effect the transfer of image dye through intervening layers of gelatin binder into a polymeric dye receiver layer and are described by the coating format shown in FIG. 2. The first layer (FIG. 2, layer 14) contains gelatin binder and the material to be tested as a thermal solvent while the upper layer (FIG. 2, layer 16) contains the image generating chemistry comprising a silver chloride emulsion and a dispersion of a dye generating coupler in a gelatin binder. A third, protective overcoat, layer (FIG. 2, layer 15) containing gelatin and hardener is applied over the first two gelatin test layers.

Examples 1 and 2 describe in detail the preparation of the solutions and dispersions used in these examples. Examples 3 and 4 describe the same film samples processed in a second developer. Example 1 contains no added material in the first gelatin layer. Example 2 is an example of a compound of our invention according to formula I.

Example 1

Comparison

Gelatin Interlayer Melt Preparation. This is an interlayer consisting of only gelatin that serves as a control for comparison of the effect of added materials on transfer of heat-transferable dyes through gelatin layers. To 2.4 g of ethyl acetate is added, with stirring, a warm solution consisting of 28.8 g of melted and filtered 12.5% gelatin and 4.3 g of a 10% solution of surfactant-A (Alkanol XC™, DuPont) in 54.5 g of distilled water. This mixture is dispersed by three passes through a Gaulin Dispersion Mill set at a gap of 0.125 mm. To 60 g of this dispersion is added 1.5 g of a 10% solution of surfactant-B (Active Olin 10G™), 63.7 g of distilled water and 4.8 g of melted and filtered 12.5% gelatin to prepare a coating melt.

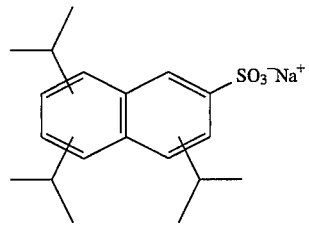

Surfactant-A

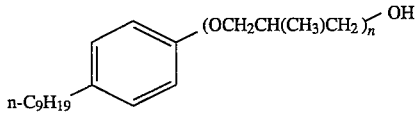

Surfactant-B

Dispersion Melt Preparation. To a warmed mixture of 8.064 g of coupler M-1 and 24.50 g of ethyl acetate is added, with stirring, a warmed solution of 134.4 g of 12.5% gelatin in 236.2 g of distilled water and 16.8 g of a 10% solution of surfactant-A. This mixture is dispersed by three passes through a Gaulin Dispersion Mill with a gap of 0.125 mm. To 337.5 g of this dispersion is added 8.10 g of a 10% solution of surfactant-B, 489.6 g of distilled water and 64.8 g of 12.5% gelatin.

Emulsion Melt Preparation. To 84.2 g of an undoctored AgCl cubic emulsion spectrally sensitized with a green sensitizing dye is added 53.3 g of 12.5% gelatin and 474 g of distilled water. The resulting melt has a silver content of 16.0 g of silver per kg of melt.

Protective Overcoat Melt Preparation. To 1840 g of distilled water is added 384 g of melted 12.5% gelatin and 36 g of a 10% solution of surfactant-B. Within one minute of coating the protective overcoat 140 g of a 1.8% solution of the hardening agent, bis-(vinylsulfonyl)methane, is added.

Film Formation. The thermal solvent dispersion is coated on the corona discharge treated polymeric receiver layer paper base at an aim laydown of 1.60 g/$m^2$ for the gelatin. This paper base (Kodak Thermal Print Receiver NS Paper) consists essentially of a polycarbonate layer overcoated with a polycaprolactam layer on a titanium dioxide tinted paper. Over the first gelatin layer is coated the silver halide emulsion and chromogenic image generating layer as follows: 30 g of the emulsion melt described above is added to 100 g of the coupler dispersion melt. This image dye generating layer has an aim laydown of 1.60 g of gelatin per $m^2$, 0.26 g of silver per $m^2$ and 0.38 g of coupler per $m^2$. After overcoating with the protective overcoat/hardener layer with an aim laydown of 1.08 g gelatin per $m^2$ and at a level of 1.35% hardener relative to total gelatin, the coating is stored for 4 days prior to processing.

Photographic Processing. Several examples of each of film example 1 are individually exposed on a Kodak 1-B sensitometer with a 0.01 sec white light exposure through a HA-50 infrared filter and a 21 step 0 to 3.0 density step tablet. The films are processed for 45 sec. at 35° C. in the color developer formulation given below containing either Kodak Color 3 (CD-3) or Kodak Color Developer 2 (CD-followed by a bleach-fix for 45 sec, to remove the silver and silver halide for investigation purposes only, followed by a 90 sec wash in distilled water. The films were dried at low temperatures (less than 40° C.). Status A densitometry of the integral images prior to thermal treatment to effect dye transfer are obtained.

| Developer Solutions | |
|---|---|
| Triethanolamine | 12.41 g |
| Phorwhite REU (Mobay) | 2.30 g |
| 30% aqueous Lithium polystyrene sulfonate | 0.30 g |
| 85% aqueous N,N-diethylhydroxylamine | 5.40 g |
| Lithium sulfate | 2.70 g |
| Kodak Color Developing Agent (CD-3 or CD-2) | 0.01145 moles |
| 60% aqueous 1-Hydroxyethyl-1, 1-diphosphonic acid | 1.16 g |
| Potassium Carbonate, anhydrous | 21.16 g |
| Potassium bicarbonate | 2.79 g |
| Potassium chloride | 1.60 g |
| Potassium bromide | 7.00 mg |
| Water to make one liter | pH 10.04 ± 0.05 at 27° C. |

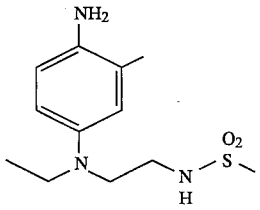

CD-3

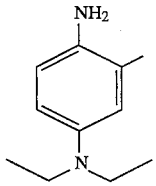

CD-2

| Bleach-Fix Solution | |
|---|---|
| Ammonium thiosulfate | 127.40 g |
| Sodium metabisulfite | 10.00 g |
| Glacial Acetic Acid | 10.20 g |
| Ammonium ferric EDTA | 110.40 g |
| Water to make one liter | pH 5.50 ± 0.10 at 80° F. |

Heat Activated Image Transfer. Dried integral films are laminated with gelatin subbed ESTAR™ film base and passed through a set of heated rollers at 0.635 cm./sec. with roller surface temperatures of 110° C. and a pressure of 140 kPa. The two film bases are separated; the gelatin layers adhere to the gelatin subbed ESTAR™ base and are thus separated from the polymeric dye receiver layer and its support. Status A reflection densitometry is obtained on the polymeric dye-receiver layer coated on a reflective support. These density values determined with the appropriate Status A filter are given in Example 1 in Table III.

Example 2

Invention

This film is identical to that of example 1 except that the gelatin layer (FIG. 2 layer 14) between the dye receiver and the dye generating layer contains a material tested as a thermal solvent. This coating is prepared in the following manner.

Thermal Solvent Melt Preparation. To a mixture of 4.30 g of the thermal solvent TS-1 (4-n-decylsulfonylphenol) in 4.30 g of ethyl acetate is added, with stirring, a warm solution consisting of 34.3 g of melted and filtered 12.5% gelatin and 4.3 g of a 10% solution of surfactant-A in 60 g of distilled water. This mixture is dispersed by three passes through a Gaulin Dispersion Mill set at a gap of 0.125 mm. To 75 g of this dispersion is added 1.5 g of a 10% solution of surfactant-B and 53.5 g of distilled water.

In a manner analogous to example 1 above the remaining dispersions, coating melts and films are prepared. This film is exposed, developed, blixed, dried and thermally treated as described in example 1.

Table III shows the various densities obtained for these two examples. The original (integral) DlogE scales of both example films are comparable. For example 1 with a 1.60 g/m$^2$ interlayer of gelatin there is a transfer of a green dye density (observed Status A green density of processed film less the reflection green density of 0.05 for an unprocessed polymeric receiver layer) of only 0.031 with one pass and only 0.109 with three passes through the heated rollers for the image step that has a density in the integral film of 2.11. For example 2 in which the interlayer contains both gelatin and the thermal test material, TS-1, there is a substantial transfer of image dye as measured by the green density. For a 1-pass and a 3-pass treatment through the heated rollers there is obtained a net image density of 0.93 and 1.45 respectively in the polymeric dye-receiver layer for the step with a density in the original integral film of 2.11. This represents a transfer of 45 and 71% of the dye density in the original image in comparison to 5% or less dye density transfer for the comparison film.

TABLE III

| | | | | Obs. Green Density | | |
|---|---|---|---|---|---|---|
| Expl | Type | Thermal | clogP | Integral | 1-pass Rec | 3-pass Rec |
| 1 | Comp. | none | | 2.12 | 0.099 | 0.159 |
| 2 | Invent. | TS-1 | 5.285 | 2.11 | 0.980 | 1.495 |

Examples 3 and 4

The films described above in examples 1 and 2 are exposed then processed in a developer solution in which an equimolar change of the color developer was made from CD-3 to CD-2. All other components in the developer solution were unchanged in identity and concentration except as required to adjust the pH of the developer solution. After image development these films were dried and thermally processed as described in examples 1 and 2. The results are summarized in Table IV. As can be seen the coating containing the phenolic material of this invention transfers image density to the polymeric receiver layer whereas the comparison film not containing any thermal solvent transfers less than 4% of the original image density after 3 passes through the heated rollers.

TABLE IV

| | | | | Obs. Green Density | | |
|---|---|---|---|---|---|---|
| Expl | Type | Thermal | clogP | Integral | 1-pass Rec | 3-pass Rec |
| 3 | Comp. | none | | 2.12 | 0.116 | 0.124 |
| 4 | Invent. | TS-1 | 5.285 | 2.11 | 1.265 | 1.439 |

Examples 5–8

Hydroxybenzenes with para substituted hydrogen bond accepting groups comprising sulfonamide (—$SO_2NH$—), sulfide (—S—) and ether (—O—) are tested as thermal solvents. The films containing TS-4, TS-5, TS-6 and mixtures of TS-2 and TS-3 are prepared as described for example 2. These films are exposed, developed, blixed, dried and thermally treated as described in example 1. The results are summarized in Table V. Coating example 5 containing an equal weight mixture of sulfonamido-phenols, TS-2 and TS-3, results in good transfer of dye density to the receiver layer. Coating 8 containing TS-6 with an ether hydrogen bond accepting group is less effective than example 5 but results in significant dye density transfer. In examples 6 and 7 containing TS-4 and TS-5 with sulfide hydrogen bond accepting groups there is a negligible transfer of density for either a 1 or 3 pass treatment Both aryl ethers and arylsulfides are expected to be relatively weak hydrogen bond acceptors.

TABLE V

| | | | | Obs. Green Density | | |
|---|---|---|---|---|---|---|
| Expl | Type | Thermal | clogP | Integral | 1-pass Rec | 3-pass Rec |
| 5 | Invent. | TS-2&3 | >5.280 | 2.00 | 0.761 | 1.240 |
| 6 | Invent. | TS-5 | 6.795 | 2.18 | 0.112 | 0.094 |
| 7 | Invent. | TS-4 | 5.737 | 2.22 | 0.056 | 0.039 |
| 8 | Invent. | TS-6 | 5.806 | 2.20 | 0.230 | 0.410 |

Examples 9–11

The films described above in examples 5, 6 and 7 are exposed as described for example 1 and processed in a developer solution in which an equimolar change of the color developer is made from CD-3 to CD-2. All other components in the developer solution are unchanged in identity and concentration except as required to adjust the pH of the developer solution. After image development these films were dried and thermally processed as described for examples 1 and 2. The results are summarized in Table VI. Example 9 containing a mixture of alkyl sulfonamidophenol thermal solvents TS-2 and TS-3 transfer significant dye density. Examples 10 and 11 containing TS-4 and TS-5 with sulfide hydrogen bond accepting groups results in a significant amount of dye density transfer for both 1 and 3 pass treatments. A comparison film not containing any thermal solvent transfers less than 4% of the original image density.

TABLE VI

| | | | | Obs. Green Density | | |
|---|---|---|---|---|---|---|
| Expl | Type | Thermal Solvent | clogP | Integral | 1-pass Rec | 3-pass Rec |
| 9 | Invent. | TS-2&3 | >5.28 | 2.08 | 0.590 | 0.992 |
| 10 | Invent. | TS-5 | 6.795 | 1.93 | 0.212 | 0.390 |
| 11 | Invent. | TS-4 | 5.737 | 2.01 | 0.302 | 0.498 |

Examples 12–14

Thermal Solvent Test Employing a Yellow Dye Forming Coupler. Three film examples are prepared in a manner analogous to examples 1 and 2 above, using a yellow dye forming coupler, Y-1, and a blue sensitized cubic emulsion in place of M-1 and a green sensitized emulsion, respectively. In this example TS-1 is compared with no added hydroxybenzene compound and with a hydroxybenzene without a hydrogen bond accepting functional group (CS-1). The thermal solvent

CS-1

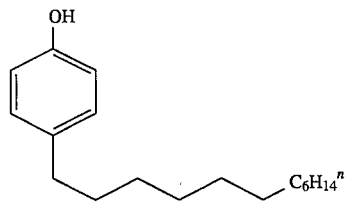

test layer is coated at gelatin laydown of 1.40 g/$m^2$ and a thermal solvent test compound at 1.30 g/$m^2$. The dye generating layer is coated at 1.40 g/$m^2$ of gelatin, 0.53 g/$m^2$ of coupler Y-1 and 0.38 g/$m^2$ of Ag. The photographic development and thermal processing is as described in example 2. In these examples the gelatin layers of the integral developed films are removed from the dye receiver layer prior to thermal processing by strippping with adhesive films. These film samples, free of the dye generating gelatin layers, are referred to as 0-pass receivers and illustrate the dye density transfer that occurs in the treatment steps prior to thermal treatment. The original or integral DlogE scales of both example films are similar. The densitometry for the integral element and the 0-, 1-, and 3-pass receiver layers for these examples is given in Table VI.

For all three example films the dye density transferred to the dye-receiver layer in the absence of a thermal processing step (0-pass) is quite small indicating the absence of significant transfer under aqueous processing. For film example 12 with a 1.40 g/$m^2$ interlayer of gelatin there is a transfer of a green dye density (observed Status A blue density of processed coating less the reflection blue density of 0.05 for an unprocessed polymeric receiver layer) of only 0.021 with one pass and only 0.034 with three passes through the heated rollers for the image step that has a density in the integral (0-pass) film of 2.15. Similarly the comparative compound CS-1, without a hydrogen bond accepting functional group, transfers less than 6% of the integral dye density after 3 passes through the heated rollers. For film example 15 in which the interlayer contains both gelatin and the thermal test material, TS-1, there is a substantial transfer of image dye as measured by the blue density. For a 1-pass and a 3-pass treatment through the heated rollers there is obtained a net image density of 0.70 and 1.05 respectively in the polymeric dye-receiver layer for the step with a density in the original integral film of 2.04. Film example 14, with the thermal solvent present, transfers approximately 30-fold as much dye density as the comparison example without any thermal solvent.

TABLE VII

| | | | | Obs. Blue Density | | | |
|---|---|---|---|---|---|---|---|
| | | Thermal | | Inte- | Receiver | | |
| Expl | Type | Solvent | clogP | gral | 0-pass | 1-pass | 3-pass |
| 12 | Comp. | none | • | 2.15 | 0.071 | 0.068 | 0.084 |
| 13 | Comp | CS-1 | 7.793 | 1.91 | 0.062 | 0.143 | 0.156 |
| 14 | Invent. | TS-1 | 5.737 | 2.04 | 0.073 | 0.748 | 1.095 |

Examples 15–17

The films described above in examples 12–14 are exposed and processed in a developer solution in which an equimolar change of the color developer is made from CD-3 to CD-2. All other components in the developer solution are unchanged in identity and concentration except as required to adjust the pH of the developer solution. After image development these films are dried and thermally processed as described in examples 12 through 14. The results are summarized in Table VIII. The mating (example 17) containing the thermal solvent, TS-1, transfers more than of the integral image density to the polymeric receiver layer in 3 passes whereas the comparison film that does not contain any thermal solvent transfers less than 5% of the original image density. Comparative compound CS-1, a hydroxybenzene without a hydrogen bond accepting functional group, transfers less than 4% of the integral dye density to the receiver layer.

TABLE VIII

| Expl | | Thermal | | Obs. Blue Density | | | |
|---|---|---|---|---|---|---|---|
| | | | | Inte- | Receiver | | |
| No. | Type | Solvent | clogP | gral | 0-pass | 1-pass | 3-pass |
| 15 | Comp. | none | | 2.21 | 0.093 | 0.094 | 0.106 |
| 16 | Comp | CS-1 | 7.793 | 2.07 | 0.081 | 0.079 | 0.089 |
| 17 | Invent. | TS-1 | 5.737 | 2.06 | 0.127 | 0.986 | 1.389 |

What is claimed is:

1. An aqueous-developable chromogenic photographic heat-transferable non-aqueous dye-diffusion-transfer photographic element comprising radiation sensitive silver halide, a dye-providing compound that forms or releases a heat-transferable image dye upon reaction of said compound with the oxidation product of a primary amine developing agent, a hydrophilic binder, and a thermal solvent for facilitating non-aqueous diffusion transfer wherein said thermal solvent has the formula (II)

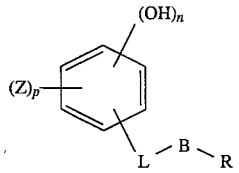

(II)

wherein n is 1, 2 or 3;

is 0 to 5-n;

Z is a substituent, where each Z consists independently of groups selected from alkyl groups of 1 to 8 carbon atoms or halogens;

L is an alkyl group of 1 to 6 carbon atoms or an alkoxy group of 2 to 6 carbon atoms or is absent;

B is a hydrogen bond accepting group selected from the group of sulfur or XGY where X and Y are each independently absent, O, or $NR^b$, where $R^b$ is hydrogen or a primary alkyl, primary alkylaryl, or aryl group of from 1 to 8 carbons, and where G is a sulfonyl group;

at least one OH group and any hydrogen bond accepting atom in B cannot hydrogen bond to form a ring of either 5 or 6 atoms.

R is an alkyl, aryl, or arylalkyl group of 1 to 18 carbon atoms;

the calculated log of the octanol/water partition coefficient (clogP) is greater than 3 and less than 10.

2. The element of claim 1, wherein said element further comprises a dye-receiving layer.

3. The element of claim 1, wherein the total amount of said binder is from 0.2 to 20 $g/m^2$.

4. The element of claim 1, wherein said hydrophilic binder is gelatin.

5. The element of claim 1, wherein the amount of thermal solvent incorporated in a given layer is 40 to 120% by weight of the total amount of hydrophilic binder in said layer.

6. The element of claim 1, wherein the amount of thermal solvent incorporated in a given layer is 10 to 120% by weight of the total amount of hydrophilic binder in said element.

7. The element of claim 1, wherein the amount of thermal solvent incorporated is 100 to 3000 $mg/m^2$ for photographic elements having only a single color record, is 200 to 4500 $mg/m^2$ for photographic elements having only two color records, or is 400 to 6000 $mg/m^2$ for photographic elements comprising three or more color records.

8. The element of claim 1, wherein said dye forming compound has a dye forming fragment having a formula weight of at least 90 and less than 600.

9. The element of claim 1, wherein said dye forming compound has a dye forming fragment having a formula weight of at least 110 and less than 400.

10. The element of claim 1, where said dye-forming compound is devoid of functional groups with aqueous $pK_a$ values for proton loss of less than 6.

11. The element of claim 1, wherein said element further comprises a high boiling liquid comprising 1,1-bis-(3,4-dimethylphenyl)ethane.

12. The element of claim 1, wherein said calculated logP for said thermal solvent according to formula (II) is greater than 4 and less than 10.

13. The element of claim 1, wherein said thermal solvent is not dispersed with a dye-forming compound.

14. The element of claim 1, where in formula (II)

n is 1;

L is an alkyl group of 1 to 6 carbon atoms or an alkoxy group of 2 to 6 carbons;

B is a sulfonyl group;

R is an alkyl, aryl, or arylalkyl group of 2 to 16 carbon atoms.

15. The element of claim 1, where in formula (II)

n is 1;

L is an alkyl group of 1 to 6 carbon atoms or an alkoxy group of 2 to 6 carbons;

B is the group XGY where X and Y are each independently $NR^b$, where $R^b$ is hydrogen or a primary alkyl, primary alkylaryl, or aryl group of from 1 to 8 carbons, and where G is a sulfonyl group;

R is an alkyl, aryl, or arylalkyl group of 2 to 16 carbon atoms.

16. The element of claim 1, where said thermal solvent according to formula (II) comprises either a 3-sulfamoylphenol, a 4-sulfamoylphenol, where $R^b$ is hydrogen or a primary alkyl, primary alkylaryl, or aryl group of from 1 to 8 carbons and R is an alkyl group or an alkylaryl group of from 6 to 18 carbons atoms.

17. The element of claim 1, where said thermal solvent according to formula (II) comprises either a 3-sulfonylphenol or a 4-sulfonylphenol, where where R is an alkyl group or an alkylaryl group of from 6 to 18 carbons atoms.

18. The element of claim 1, wherein a link between two or more thermal solvents of formula (II) is formed at R, $L^1$, $L^2$, or Q.

19. The element of claim 1, that contains a plurality of thermal solvents according to formula (II).

20. The element of claim 1, wherein said aqueous-developable chromogenic photographic heat-transferable non-aqueous dye-diffusion-transfer photographic element is a multilayer aqueous-developable color-photographic heat-transferable non-aqueous dye-diffusion-transfer photographic element further comprising a support;

a heat-transferable yellow dye producing layer containing a heat-transferable yellow dye providing compound, a radiation sensitive silver halide, and a hydrophilic binder;

a heat-transferable magenta dye producing layer containing a heat-transferable magenta dye providing compound, a radiation sensitive silver halide, and a hydrophilic binder;

a heat-transferable cyan dye producing layer containing a heat-transferable cyan dye providing compound, a radiation sensitive silver halide, and a hydrophilic binder.

21. A process for forming an improved dye image comprising the steps of:

providing in an aqueous-developable chromogenic photographic heat-transferable non-aqueous dye-diffusion-transfer photographic element comprising radiation sensitive silver halide, a heat-transferable dye-providing compound that forms or releases a heat-transferable image dye upon reaction of said compound with the oxidation product of a primary amine developing agent, a hydrophilic binder, and a thermal solvent for facilitating non-aqueous diffusion transfer wherein said thermal solvent has the formula according to formula (II)

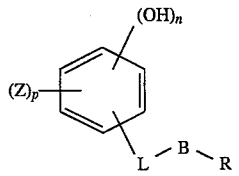

(II)

wherein n is 1, 2 or 3;

p is 0 to 5-n;

Z is a substituent, where each Z consists independently of groups selected from alkyl groups of 1 to 8 carbon atoms or halogens;

L is an alkyl group of 1 to 6 carbon atoms or an alkoxy group of 2 to 6 carbon atoms or is absent;

B is a hydrogen bond accepting group selected from the group of oxygen, sulfur or XGY where X and Y are each independently absent, O, or $NR^b$, where $R^b$ is hydrogen or a primary alkyl, primary alkylaryl, or aryl group of from 1 to 8 carbons, and where G is a sulfonyl group;

at least one OH group and any hydrogen bond accepting atom in B cannot hydrogen bond to form a ring of either 5 or 6 atoms;

R is an alkyl, aryl or alkylaryl group of from 1 to 18 carbon atoms;

the calculated log of the octanol/water partition coefficient (clogP) is greater than 3 and less than 10;

exposing said non-aqueous dye-diffusion transfer element to actinic radiation;

contacting said element with an aqueous-developing solution, wherein said solution comprises a primary amine developing agent;

contacting said element with an aqueous bath of acidic pH;

drying said element;

providing a dye-receiving layer and a contiguous, dimensionally stable, support where said dye receiving layer is in physical contact with said dye-diffusion transfer element;

heating said dye-diffusion transfer element and dye-receiving layer to effect dye-diffusion transfer; and separating said dye-receiving layer and contiguous support from said dye transfer element.

22. The process of claim 21, wherein said element further comprises a dye-receiving layer.

23. The process of claim 21, wherein said dye forming compound has a dye forming fragment having a formula weight of at least 110 and less than 400.

24. The process of claim 21, where said dye-forming compound is devoid of functional groups with aqueous $pK_a$ values for proton loss of less than 6.

25. The process of claim 21 for forming an improved multicolor dye image comprising the steps of:

providing aqueous-developable color-photographic heat-transferable non-aqueous dye-diffusion-transfer photographic element comprising a support;

a heat-transferable yellow dye producing layer containing a heat-transferable yellow dye providing compound, a radiation sensitive silver halide, and a hydrophilic binder;

a heat-transferable magenta dye producing layer containing a heat-transferable magenta dye providing compound, a radiation sensitive silver halide, and a hydrophilic binder;

a heat-transferable cyan dye producing layer containing a heat-transferable cyan dye providing compound, a radiation sensitive silver halide, and a hydrophilic binder.

26. A heat developable chromogenic photographic heat-transferable dye-diffusion transfer element comprising radiation sensitive silver halide, a reducing agent, a dye-forming compound wherein said compound forms a heat transferable image dye upon reaction of said compound with the oxidation product of said reducing agent, hydrophilic binder, and a thermal solvent wherein said thermal solvent has the formula (II)

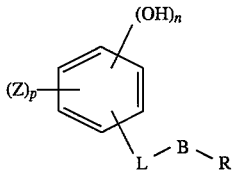

(II)

wherein n is 1, 2 or 3;

is 0 to 5-n;

Z is a substituent, where each Z consists independently of groups selected from alkyl groups of 1 to 8 carbon atoms or halogens;

L is an alkyl group of 1 to 6 carbon atoms or an alkoxy group of 2 to 6 carbon atoms or is absent;

B is a hydrogen bond accepting group selected from the group of sulfur or XGY where X is absent or is O and Y is absent, O, or $NR^b$, where $R^b$ is hydrogen or a primary alkyl, primary alkylaryl, or aryl group of from 1 to 8 carbons, and where G is a sulfonyl group;

at least one OH group and any hydrogen bond accepting atom in B cannot hydrogen bond to form a ring of either 5 or 6 atoms;

R is an alkyl, aryl or alkylaryl group of from 1 to 18 carbon atoms;

the calculated log of the octanol/water partition coefficient (clogP) is greater than 3 and less than 10.

27. The element of claim 26, wherein said reducing agent is a 4-(N,N-dialkylamino)phenyl sulfamic acid salt.

28. The element of claim 26, wherein said element further comprises a dye-receiving layer.

29. The element of claim 26, wherein the dye forming fragment of said dye forming compound has a formula weight of at least 110 and less than 400.

30. The element of claim 26, wherein said heat-developable chromogenic photographic heat-transferable non-aqueous dye-diffusion-transfer photographic element is a multilayer aqueous-developable color-photographic heat-transferable non-aqueous dye-diffusion-transfer photographic element comprising a support;

a heat-transferable yellow dye producing layer containing a heat-transferable yellow dye providing compound, a radiation sensitive silver halide, and a hydrophilic binder;

a heat-transferable magenta dye producing layer containing a heat-transferable magenta dye providing compound, a radiation sensitive silver halide, and a hydrophilic binder;

a heat-transferable cyan dye producing layer containing a heat-transferable cyan dye providing compound, a radiation sensitive silver halide, and a hydrophilic binder.

31. A process for forming an improved dye image in a photographic thermal dye-diffusion transfer element comprising the steps of:

providing a heat-developable chromogenic photographic non-aqueous dye-diffusion transfer dement comprising;

radiation sensitive silver halide, a reducing agent, a heat-transferable dye-forming compound wherein said compound forms or releases a heat-transferable dye upon reaction of said compound with the oxidation product of a reducing agent, a hydrophilic binder, and a thermal solvent for facilitating non-aqueous dye diffusion transfer wherein said thermal solvent has the formula according to formula (II)

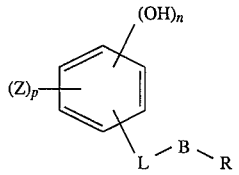

(II)

wherein n is 1, 2 or 3;

is 0 to 5-n;

Z is a substituent, where each Z consists independently of groups selected from alkyl groups of 1 to 8 carbon atoms or halogens;

L is an alkyl group of 1 to 6 carbon atoms or an alkoxy group of 2 to 6 carbon atoms or is absent;

B is a hydrogen bond accepting group selected from the group of sulfur or XGY where X is absent or is O and Y is absent, O, or $NR^b$, where $R^b$ is hydrogen or a primary alkyl, primary alkylaryl, or aryl group of from 1 to 8 carbons, and where G is a sulfonyl group;

at least one OH group and any hydrogen bond accepting atom in B cannot hydrogen bond to form a ring of either 5 or 6 atoms;

R is an alkyl, aryl or alkylaryl group of 1 to 18 carbon atoms;

the calculated log of the octanol/water partition coefficient (clogP) is greater than 3 and less than 10;

exposing said heat-developable element to actinic radiation heating said element to effect thermal development and dye-diffusion transfer, and separating said dye-receiving layer and contiguous support from said dye-diffusion transfer element by automated mechanical means.

32. The process of claim 31, wherein said element further comprises a dye-receiving layer.

33. The process of claim 31, wherein the dye forming fragment of said dye forming compound has a formula weight of at least 110 and less than 400.

34. The process of claim 31 for forming an improved multicolor dye image comprising the steps of:

providing aqueous-developable color-photographic heat-transferable non-aqueous dye-diffusion-transfer photographic element comprising a support;

a heat-transferable yellow dye producing layer containing a heat-transferable yellow dye providing compound, a radiation sensitive silver halide, and a hydrophilic binder;

a heat-transferable magenta dye producing layer containing a heat-transferable magenta dye providing compound, a radiation sensitive silver halide, and a hydrophilic binder;

a heat-transferable cyan dye producing layer containing a heat-transferable cyan dye providing compound, a radiation sensitive silver halide, and a hydrophilic binder.

35. A aqueous-developable chromogenic photographic heat-transferable dye-diffusion transfer element comprising radiation sensitive silver halide, a reducing agent, a dye-forming compound wherein said compound forms a heat transferable image dye upon reaction of said compound with the oxidation product of said reducing agent, hydrophilic binder, and a thermal solvent wherein said thermal solvent has the formula (II)

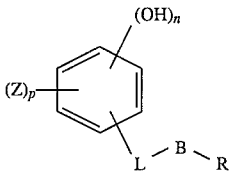

(II)

wherein n is 1;

p is 0 to 5-n:

Z is a substituent, where each Z consists independently of groups selected from alkyl groups of 1 to 8 carbon atoms or halogens;

L is an alkyl group of 1 to 6 carbon atoms or an alkoxy group of 2 to 6 carbon atoms;

B is a hydrogen bond accepting group consisting of oxygen;

at least one OH group and any hydrogen bond accepting atom in B cannot hydrogen bond to form a ring of either 5 or 6 atoms;

R is an alkyl, aryl or alkylaryl group of from 1 to 18 carbon atoms;

the calculated log of the octanol/water partition coefficient (clogP) is greater than 3 and less than 10.

36. A heat developable chromogenic photographic heat-transferable dye-diffusion transfer element comprising radiation sensitive silver halide, a reducing agent, a dye-forming compound wherein said compound forms a heat transferable image dye upon reaction of said compound with the oxidation product of said reducing agent, hydrophilic binder, and a thermal solvent wherein said thermal solvent has the formula (II)

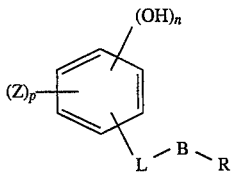

(II)

wherein n is 1;

p is 0 to 5-n;

Z is a substituent, where each Z consists independently of groups selected from alkyl groups of 1 to 8 carbon atoms or halogens;

L is an alkyl group of 1 to 6 carbon atoms or an alkoxy group of 2 to 6 carbon atoms;

B is a hydrogen bond accepting group consisting of oxygen;

at least one OH group and any hydrogen bond accepting atom in B cannot hydrogen bond to form a ring of either 5 or 6 atoms;

R is an alkyl, aryl or alkylaryl group of from 1 to 18 carbon atoms;

the calculated log of the octanol/water partition coefficient (clogP) is greater than 3 and less than 10.

* * * * *

UNITED STATES PATENT AND TRADEMARK OFFICE

CERTIFICATE OF CORRECTION

PATENT NO. : 5,468,587

DATED : November 21, 1995

INVENTOR(S) : David S. Bailey et al.

It is certified that errors appear in the above-identified patent and that said Letters Patent is hereby corrected as shown below:

Column 31, line 48, precede "is 0 to 5-n;" with -- p --

Column 34, line 60, precede "is 0 to 5-n;" with -- p --

Column 35, line 66, precede "is 0 to 5-n;" with -- p --

Signed and Sealed this

Twelfth Day of March, 1996

*Attest:*

Bruce Lehman

BRUCE LEHMAN

*Attesting Officer*

*Commissioner of Patents and Trademarks*